US009521873B1

(12) United States Patent
Mignone

(10) Patent No.: US 9,521,873 B1
(45) Date of Patent: Dec. 20, 2016

(54) HOODIE WITH FACE MASK

(71) Applicant: Francesco Mignone, Tuckahoe, NY (US)

(72) Inventor: Francesco Mignone, Tuckahoe, NY (US)

( * ) Notice: Subject to any disclaimer, the term of this patent is extended or adjusted under 35 U.S.C. 154(b) by 322 days.

(21) Appl. No.: 14/211,055

(22) Filed: Mar. 14, 2014

Related U.S. Application Data

(60) Provisional application No. 61/783,297, filed on Mar. 14, 2013.

(51) Int. Cl.
*A42B 1/04* (2006.01)
*A42B 1/06* (2006.01)
*A42B 3/18* (2006.01)

(52) U.S. Cl.
CPC ..... *A42B 1/04* (2013.01); *A42B 1/048* (2013.01); *A42B 3/18* (2013.01); *A41D 2200/20* (2013.01)

(58) Field of Classification Search
CPC ..... A42B 1/04; A42B 1/046; A42B 1/048; A42B 3/18; A42B 1/045; A42B 1/06; A42B 1/006; A42B 1/241; A42B 1/041; A42B 1/066; A42B 1/069; A42B 1/20; A42B 1/201; A42B 1/205; A42B 1/206; A42B 1/247; A42B 1/24; A41D 1/02; A41D 3/00; A41D 1/04; A41D 3/005; A41D 3/02; A41D 3/08; A41D 27/20; A41D 2200/20; A41D 2400/42
USPC ..... 2/84, 203, 202, 172, 173
See application file for complete search history.

(56) References Cited

U.S. PATENT DOCUMENTS 202,262 A * 4/1878 Isidor ..... A41D 27/18 2/203
214,326 A * 4/1879 Troelicht ..... A42B 1/046 2/205
1,167,379 A 1/1916 Buckman et al.
1,235,927 A 8/1917 Sanborn et al.
1,423,315 A * 7/1922 Geis ..... A41D 3/08 2/84
1,482,270 A 1/1924 Shuster et al.
(Continued)

OTHER PUBLICATIONS

WAWO Polar Fleece Balaclava Warm Full Face Cover Winter Ski Mask http://www.clothing-sports-daily.com/2014/09/15/wawo-polar-fleece-balaclava-warm-full-face-cover-winter-ski-mask-beanie-cs-hat-black/ (downloaded Jan. 28, 2016).
(Continued)

*Primary Examiner* — Amy Vanatta
(74) *Attorney, Agent, or Firm* — Steven M. Hoffberg, Esq.; Ostrolenk Faber LLP

(57) ABSTRACT

A hooded sweatshirt garment having a hood, a pocket formed near a first lateral edge of the hood, having an opening bounded by an edge, the pocket having a space sufficient to contain a facemask and an attachment for retaining an edge of the facemask to the edge of the opening; the facemask, having a free edge, and elastically reinforced upper and lower edges, and a fastener portion, the facemask being configured to protect a wearer's face from wind, and to absorb perspiration, while permitting breathing through the facemask; and a corresponding fastener formed near a second lateral edge of the hood, across the face from the first lateral edge, such that when the fastener is linked to the corresponding fastener, the facemask is stretched across the face, and then the fastener is unlinked from the corresponding fastener, the facemask may be fully inserted into the pocket.

20 Claims, 30 Drawing Sheets

(56) References Cited

U.S. PATENT DOCUMENTS

| | | | | | |
|---|---|---|---|---|---|
| 2,039,478 | A | * | 5/1936 | Ensten | A42B 1/045 2/203 |
| 2,500,982 | A | | 3/1950 | Fligel | |
| 2,581,366 | A | * | 1/1952 | De Grazia | A42B 1/045 2/203 |
| 2,641,768 | A | | 6/1953 | Pipher et al. | |
| 2,682,667 | A | | 7/1954 | Michelstetter et al. | |
| 2,839,757 | A | * | 6/1958 | Gianola | A42B 1/045 2/173 |
| 2,998,611 | A | | 9/1961 | Schuessler et al. | |
| 3,271,781 | A | | 9/1966 | Sheldon et al. | |
| 3,561,010 | A | | 2/1971 | Little et al. | |
| 3,740,767 | A | | 6/1973 | Schuessler | |
| 4,038,698 | A | * | 8/1977 | Smith | A41D 3/06 126/204 |
| D293,932 | S | | 1/1988 | Ramseyer | |
| 4,768,235 | A | | 9/1988 | Webster | |
| 4,787,372 | A | | 11/1988 | Ramseyer | |
| D311,261 | S | | 10/1990 | Avey | |
| D331,297 | S | | 11/1992 | Herod | |
| D331,300 | S | | 11/1992 | Fountain | |
| 5,214,804 | A | * | 6/1993 | Carey | A41D 13/1161 2/171 |
| 5,445,863 | A | | 8/1995 | Slagle et al. | |
| 5,476,561 | A | | 12/1995 | Bylund et al. | |
| D366,347 | S | | 1/1996 | Avey | |
| 5,546,604 | A | | 8/1996 | Geller | |
| 5,551,071 | A | | 8/1996 | Nakano et al. | |
| 5,575,009 | A | * | 11/1996 | Ryvin | A41D 13/1153 2/173 |
| 5,666,671 | A | | 9/1997 | Daneshvar | |
| 5,675,838 | A | | 10/1997 | Hollinger | |
| 5,695,835 | A | | 12/1997 | Weber et al. | |
| 5,704,068 | A | * | 1/1998 | Martin | A41D 13/1153 128/201.13 |
| 5,713,077 | A | | 2/1998 | Humbrecht | |
| 5,765,230 | A | | 6/1998 | Sivret et al. | |
| 5,809,572 | A | | 9/1998 | Sisolak | |
| 5,832,538 | A | | 11/1998 | Williams | |
| 5,845,340 | A | * | 12/1998 | Frislie | A41D 13/1153 2/173 |
| D414,013 | S | | 9/1999 | Group | |
| 6,070,578 | A | | 6/2000 | Baughman et al. | |
| 6,079,980 | A | | 6/2000 | Durand | |
| 6,163,887 | A | | 12/2000 | Rogers et al. | |
| 6,272,690 | B1 | | 8/2001 | Carey et al. | |
| 6,370,692 | B1 | | 4/2002 | Duyn et al. | |
| 6,397,395 | B1 | | 6/2002 | DeHart | |
| 6,418,561 | B1 | | 7/2002 | Gregory | |
| 6,499,141 | B1 | | 12/2002 | Egnew | |
| 6,671,886 | B1 | | 1/2004 | Reitz | |
| 6,675,394 | B2 | | 1/2004 | Egnew | |
| 6,754,909 | B1 | | 6/2004 | Samelian | |
| 6,817,036 | B1 | | 11/2004 | Reitz | |
| 6,868,852 | B2 | | 3/2005 | Gaschke | |
| D518,625 | S | | 4/2006 | Bamhouse | |
| 7,076,810 | B1 | | 7/2006 | Rossini | |
| 7,107,625 | B2 | | 9/2006 | St-Germain | |
| D532,185 | S | | 11/2006 | St-Germain | |
| 7,152,252 | B2 | | 12/2006 | Gellis et al. | |
| 7,188,374 | B2 | | 3/2007 | Carey | |
| 7,200,872 | B2 | | 4/2007 | Gregory | |
| 7,240,372 | B2 | | 7/2007 | Larson | |
| 7,296,302 | B2 | | 11/2007 | DeLorenzo et al. | |
| 7,302,710 | B2 | | 12/2007 | Thomas et al. | |
| 7,308,721 | B1 | | 12/2007 | Rivera, Jr. | |
| D563,081 | S | | 3/2008 | Van Trojen | |
| 7,340,780 | B2 | | 3/2008 | Levy | |
| D566,338 | S | | 4/2008 | Van Trojen | |
| D566,902 | S | | 4/2008 | Van Trojen | |
| 7,418,740 | B2 | | 9/2008 | Anderson et al. | |
| 7,467,422 | B2 | | 12/2008 | Bugarin | |
| 7,559,168 | B2 | | 7/2009 | Wisecup et al. | |
| 7,779,485 | B2 | | 8/2010 | Gandy | |
| D629,592 | S | | 12/2010 | Neeld | |
| 8,156,573 | B2 | | 4/2012 | Gandy | |
| 8,161,575 | B2 | | 4/2012 | Debrick | |
| D662,284 | S | | 6/2012 | Lam | |
| 8,201,276 | B2 | | 6/2012 | Asta | |
| 8,225,428 | B2 | | 7/2012 | Grilliot et al. | |
| D666,364 | S | | 8/2012 | Votel et al. | |
| D668,435 | S | | 10/2012 | Smith | |
| D671,688 | S | | 11/2012 | Sullivan, II | |
| 8,555,418 | B2 | | 10/2013 | Singh et al. | |
| 8,607,594 | B1 | | 12/2013 | Huang et al. | |
| D706,990 | S | | 6/2014 | Martin | |
| D712,097 | S | | 8/2014 | Sullivan, Jr. | |
| 8,806,664 | B1 | | 8/2014 | Judge et al. | |
| D716,022 | S | | 10/2014 | Judge et al. | |
| D718,003 | S | | 11/2014 | Bae | |
| 8,875,313 | B2 | | 11/2014 | Ramirez | |
| D719,722 | S | | 12/2014 | Bublak | |
| D722,744 | S | | 2/2015 | Brown | |
| 8,955,165 | B1 | | 2/2015 | Romero | |
| D726,970 | S | | 4/2015 | Martin | |
| D728,900 | S | | 5/2015 | White | |
| D729,457 | S | | 5/2015 | Kim | |
| D735,974 | S | | 8/2015 | Blutstein | |
| D743,110 | S | | 11/2015 | Welborn | |
| 2003/0154536 | A1 | | 8/2003 | Anderson et al. | |
| 2006/0130213 | A1 | * | 6/2006 | Mickle | A42B 1/046 2/202 |
| 2007/0204384 | A1 | | 9/2007 | Carey | |
| 2007/0266483 | A1 | | 11/2007 | Probst | |
| 2009/0064385 | A1 | | 3/2009 | Crossman et al. | |
| 2009/0151049 | A1 | | 6/2009 | Conrardy et al. | |
| 2010/0107318 | A1 | | 5/2010 | Asta | |
| 2011/0119815 | A1 | | 5/2011 | Paulson et al. | |
| 2012/0216340 | A1 | | 8/2012 | Asta | |
| 2013/0055486 | A1 | | 3/2013 | Hasbany et al. | |
| 2013/0152930 | A1 | | 6/2013 | Votel et al. | |
| 2013/0340142 | A1 | * | 12/2013 | Saladino | A42B 1/241 2/181 |

OTHER PUBLICATIONS

Loki Mort Pullover Hoodie http://jungletraining.com/forums/showthread.php?29420-Loki-Morf-Pullover-Hoodie (downloaded Jan. 28, 2016).

* cited by examiner

HOODIE WITH FACE MASK

CROSS REFERENCE TO RELATED APPLICATION

The present application is a non-provisional of, and claims priority under 35 U.S.C. §119(e) from, U.S. Provisional Patent Application No. 61/783,297, filed Mar. 14, 2013, the entirety of which is expressly incorporated herein by reference.

FIELD OF THE INVENTION

The present invention relates to protective apparel, and more particularly to a face or head protective garment.

BACKGROUND OF THE INVENTION

In cold weather there has always been a need for a face mask to block out the wind or to just keep the face warm on those extremely cold days. The face mask becomes even more relevant and a necessity when an individual chooses to run or train in the cold weather because of the wind chill generated from the velocity of the individual. Compound this motion and velocity with an already existing wind speed, and the cold air can be crippling, especially when an individual's sweat is added in due to the heat loss coefficient.

A traditional face mask is usually tightly fully wrapped around the head or in the form of a full hood/face mask conforming to the head and face with just an eye hole opening. The tightness limits breathing and can cause overheating even in the cold weather. The tightness also causes an uncomfortable contact surface when the wearer sweats in the face mask, creating a damp drippy surface.

SUMMARY OF THE INVENTION

The tuck away hoodie face mask addresses the issue of a face mask which snugly fits against the face. The face mask is incorporated into a hood, and does not have the constraints and tightness of a typical face mask that has to be tightly secured around the entire head. This design allows the wearer to maintain a comfortable breathing environment and reduces the chance of the wearer to overheat. This design also allows the wearer to avoid a wet, uncomfortable sweaty surface because the face mask does not wrap around the entire head and only contacts the face area. The face mask also has an alternate inner surface which has a towel/absorptive material lining, adapted and configured to absorb the sweat and reduce the wetness of the surface. This also cuts down on the heat loss coefficient, reducing heat loss of the wearer.

This design serves the function of a face mask to reduce wind chill and cut down on the heat loss coefficient, with the towel/absorptive material lining all the time maintaining and keeping with the traditional look and appearance of a hoodie sweatshirt.

Another problem with running and training wearing a hoodie sweatshirt is that a typical pouch pocket doesn't secure the items contained within the pouch when vigorous movement is performed, causing the stored items to fling, flare, or be tossed out of the pouch pocket. This risk reduces the utility of the pocket, which might otherwise be of great use. This is a problem because the hoodie sweatshirt is a very popular workout garment and leaves the wearer with an unusable pouch pocket. The present design solves this problem by incorporating elastic draw strings, with spring loaded locks on each end of the pouch pocket openings, to provide a closure for the pocket while still permitting entry of the hands as desired, without requiring operation of a zipper. This is achieved by adding an extra donut shaped fabric portion attached or sewn at each end of the pouch pocket openings, just inside the pouch pocket openings.

In general, the face masks according to the present design have a shaped upper edge which conforms to the anatomy of the human face (e.g., nose and cheek bones). The face mask may also have a nose bulge and ventilation holes for nose and mouth. The face mask may also have a higher degree of rigidity that the hood, and be conformed to a face, but the face mask preferably remains pliant and flexible, so that it lies flat in the pocket.

The face mask interior can be formed of an absorptive material such a towel or non-woven material, to collect the sweat and make the wearer more comfortable. In other embodiments, a heat-retaining non-absorptive wicking material may be used, such as a polyethylene microfiber material. Likewise, the hoodie may have its entire inner lining composed of towel/absorptive material to soak up sweat and reduce the wet uncomfortable sweaty contact surface, or, for example, heat-retaining non-absorptive wicking material may be used, such as a polyethylene microfiber material.

The hoodie sweatshirt may have securing pouch pockets with elastic draw string and spring loaded locks, or the pockets may be closed with Velcro® or other hook and loop fastener material (also known as a statistical fastener), a zipper, snap buttons, standard buttons, and magnets.

It is therefore an object to provide a facemask for a hooded garment, e.g., formed of a perspiration absorbent or wind-protective material, having a nasal region and a mouth region configured to permit air for breathing to pass therethrough, having tensionable elastically reinforced top and bottom edges, and having fastener portions at lateral edges thereof, the fasteners being configured to attach to the hood of the hooded garment to thereby be retained by the fasteners in front of a face of the wearer.

A further object provides a hooded garment, comprising: a hood extending upward from a neck region; potential space formed between adjacent layers of material of the hood, defining a pocket; a facemask, attached to the hood adjacent to an edge of the pocket and having a free edge, extending a sufficient distance such that the facemask is configured to extend across a mouth and nose of a human wearer to an anchor region on a side of the hood opposite the pocket; at least one anchor element disposed on the free edge of the facemask; and at least one anchor attachment element corresponding to the at least one anchor element, disposed on the anchor region, the at least one anchor element being attachable to and detachable from the at least one anchor attachment element, being configured in an attached state to retain the facemask in position across the mouth and nose of the wearer during exercise, the facemask being configured to fit within the pocket in the detached state of the at least one anchor attachment element and the at least one anchor element. The edge of the pocket may have a second anchor region, having at least one second anchor attachment element configured to attach to at least one second anchor element disposed on the facemask, whereby the facemask is detachable from the hood.

Another object provides a hooded garment, comprising: a shirt having a hood extending upward from a neck region; a pocket formed near a first lateral edge of the hood, having an opening bounded by an edge, the pocket having a space sufficient to contain a facemask and an attachment for retaining an edge of the facemask to the edge of the opening; the facemask, having a free edge, and elastically reinforced upper and lower edges, and a fastener portion, the facemask being configured to protect a wearer's face from wind, and to absorb perspiration, while permitting breathing through the facemask; and a corresponding fastener formed near a second lateral edge of the hood, across the face from the first lateral edge, such that when the fastener is linked to the corresponding fastener, the facemask is stretched across the face, and then the fastener is unlinked from the corresponding fastener, the facemask may be fully inserted into the pocket. The edge of the pocket may have a second corresponding fastener, and the facemask has a second fastener, whereby the facemask is fully detachable from the hooded garment.

The facemask may be configured to fit within the pocket substantially without bunching.

The facemask may have a mouth hole and/or at least one nose hole.

The at least one anchor element or fastener may be incompatible with the at least one second anchor attachment element or second corresponding fastener, to thereby facilitate attachment in a proper orientation.

The facemask may have a first surface having a different texture from a second surface, the facemask being adapted to be placed across the nose and mouth of the wearer with either the first surface or second surface in contact with the wearer's skin.

The potential space may be defined between two sheets of material forming the hood, wherein the edge of the pocket is defined at a seam between the two sheets of material. The pocket also may be formed on an exterior surface of the hood, the edge of the pocket being displaced from an edge of the hood. The pocket may also be formed having the edge an interior surface of the hood.

A chin flap may be formed at a lower portion of the hood, the chin flap extending from a neck upward.

The at least one anchor element or fastener may comprise at least one of a hook and loop fastener, a button hole fastener, a snap button fastener, a zipper fastener, an adhesive fastener, a barbed fastener and a magnetic fastener.

At least one edge of the facemask may be tensionable with a tightenable drawstring.

The elastically reinforced upper and lower edges of the facemask may be selectively tensionable.

BRIEF DESCRIPTION OF THE DRAWINGS

Certain embodiments of the present invention are illustrated in the following drawings.

DESCRIPTION OF PREFERRED EMBODIMENTS

It is noted that, while a preferred embodiment provides a hoodie sweatshirt having an integral (but possibly detachable) hood portion and sweatshirt portion, the hood maybe a modular component available for attachment to other compatible garments. Further, because the hood and facemask may become soiled or wet during use, interchangeable hoods, facemasks, and sweatshirts may be provided.

Hoodie with Inside Pocket

Figure 1:
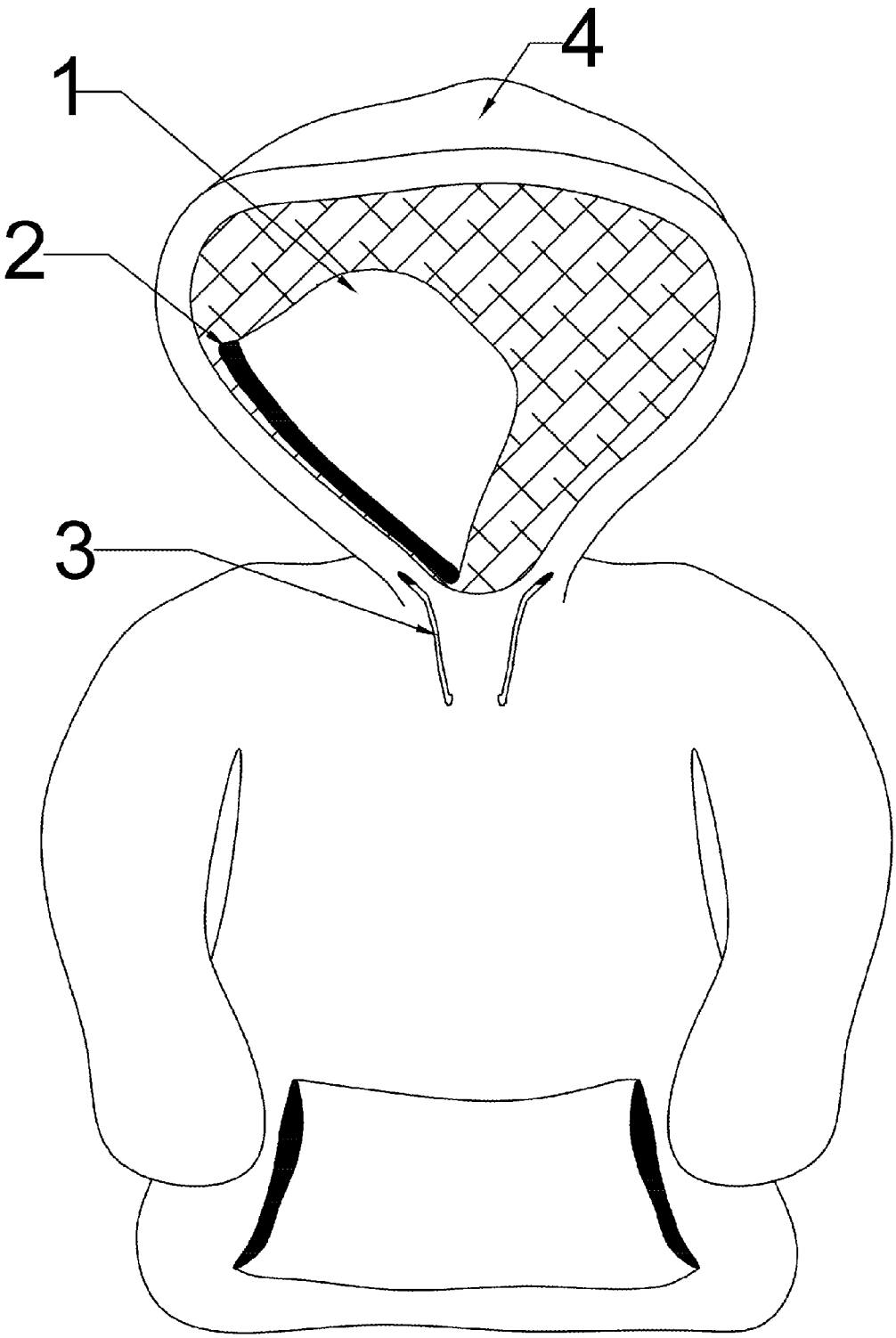
FIG. 1 shows a front view of a hoodie with inside pocket.
Figure 2:
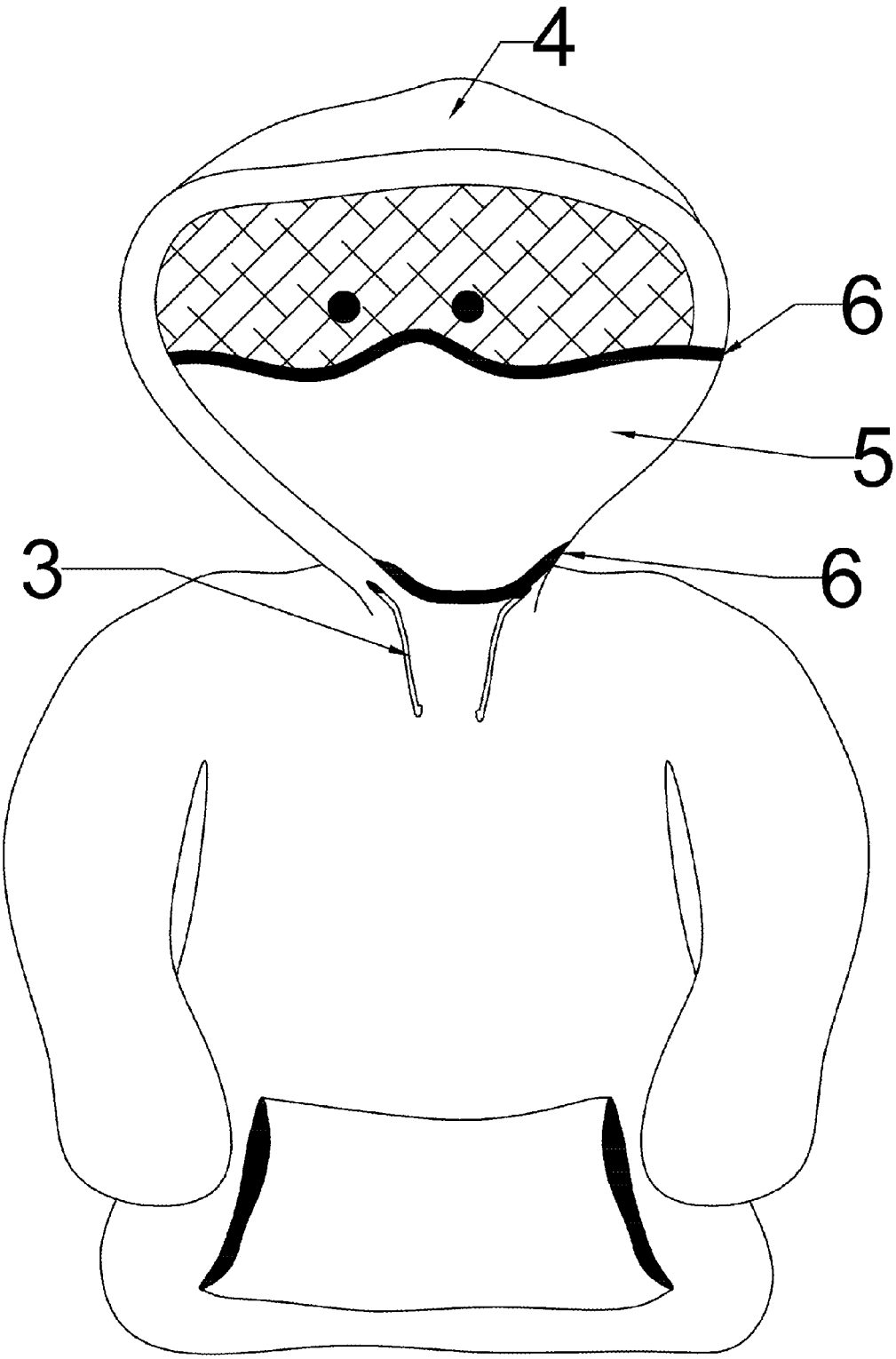
FIG. 2 shows a front view of a hoodie showing a tuck away face mask fully extended from inside pocket and anchored to opposite side.
Figure 3:
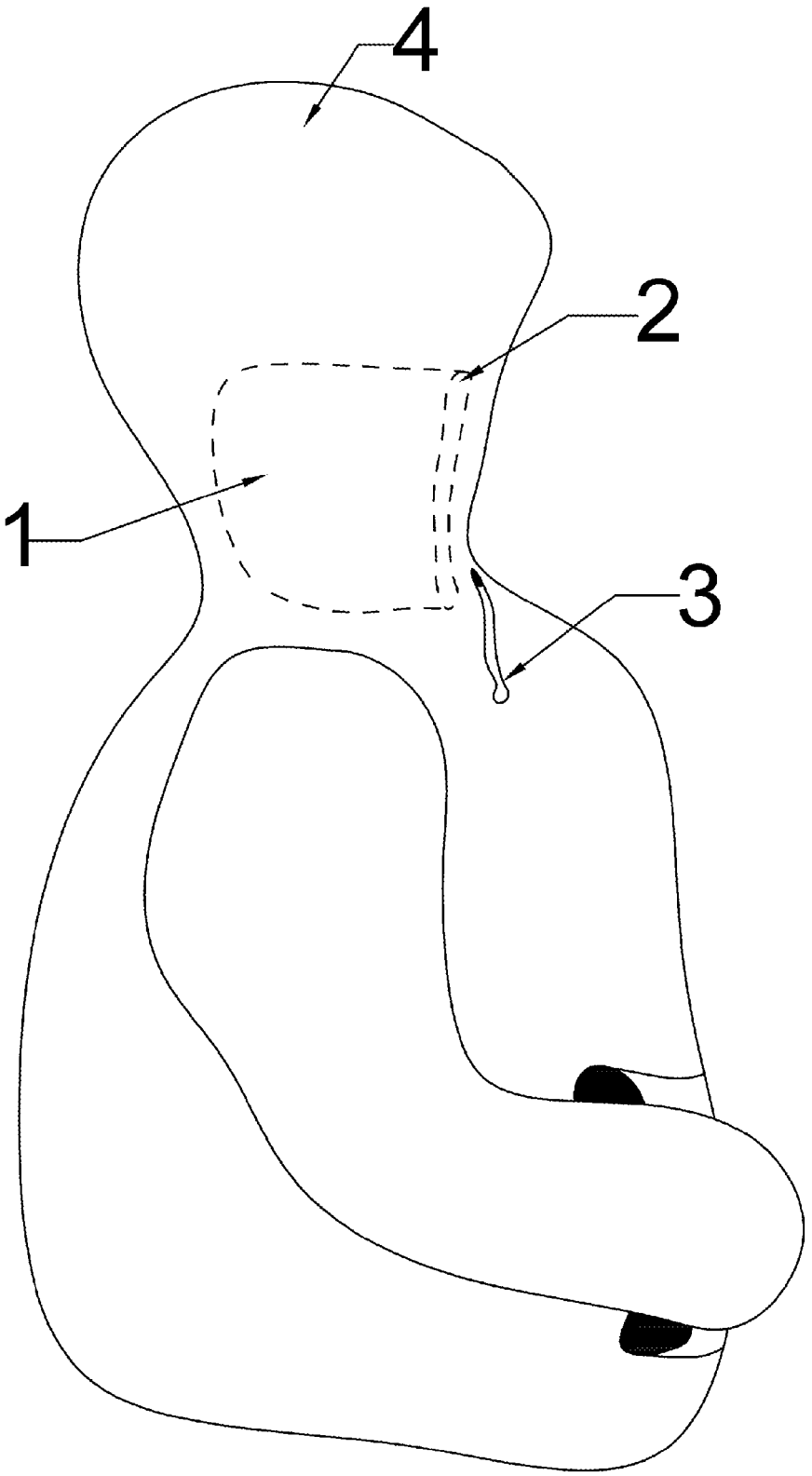
FIG. 3 shows a side view of a hoodie with inside pocket shown with hatch line.

A hoodie with a fabric pocket 1 attached to the inside lining of the hood 4 is shown in FIGS. 1-3 and 16. The width of the pocket 1 and opening 2 is approximately 6-11 inches wide from top to bottom and 11-14 inches long front to back of the hood. The pocket 1 is located on the inside surface of the hood 4 just inside the front opening of the hood. The pocket's 1 opening 2 faces front towards the opening of the hood 4. A tuck-away face mask 5, shown in FIG. 2 is approximately 6-11 inches wide and 11-14 inches in length. The tuck-away face mask 5 is attached to the inside lining of the hood 4 just inside the opening 2 of the inside pocket. The face mask 5 has its inside facing surface (surface in contact with the wearers face) lined with fleece and the outside facing surface of the mask 5 consisting of the same material of the outer hood or some other variation of materials. The face mask 5 has a fastener at the unfixed end opposite the pocket 1 which can be attached across the face to the other side of the hood 4 by a variety of fastener types, e.g., hook and loop fastener (e.g., Velcro®), buttons, a snap button, a zipper, magnet, or self adhering fabric. The face mask 5 may have a top and bottom elastic band 6 for a more snug and tightened fit. The hood 4 has a face mask anchor fastener 18, 19, 20, 21, 29 on the outside or inside of the hood 4 opposite the fixed end of the face mask 5 and an anchor fastener cover flap 22 covering these anchor fasteners.

Hoodie with Outside Pocket

Figure 4:
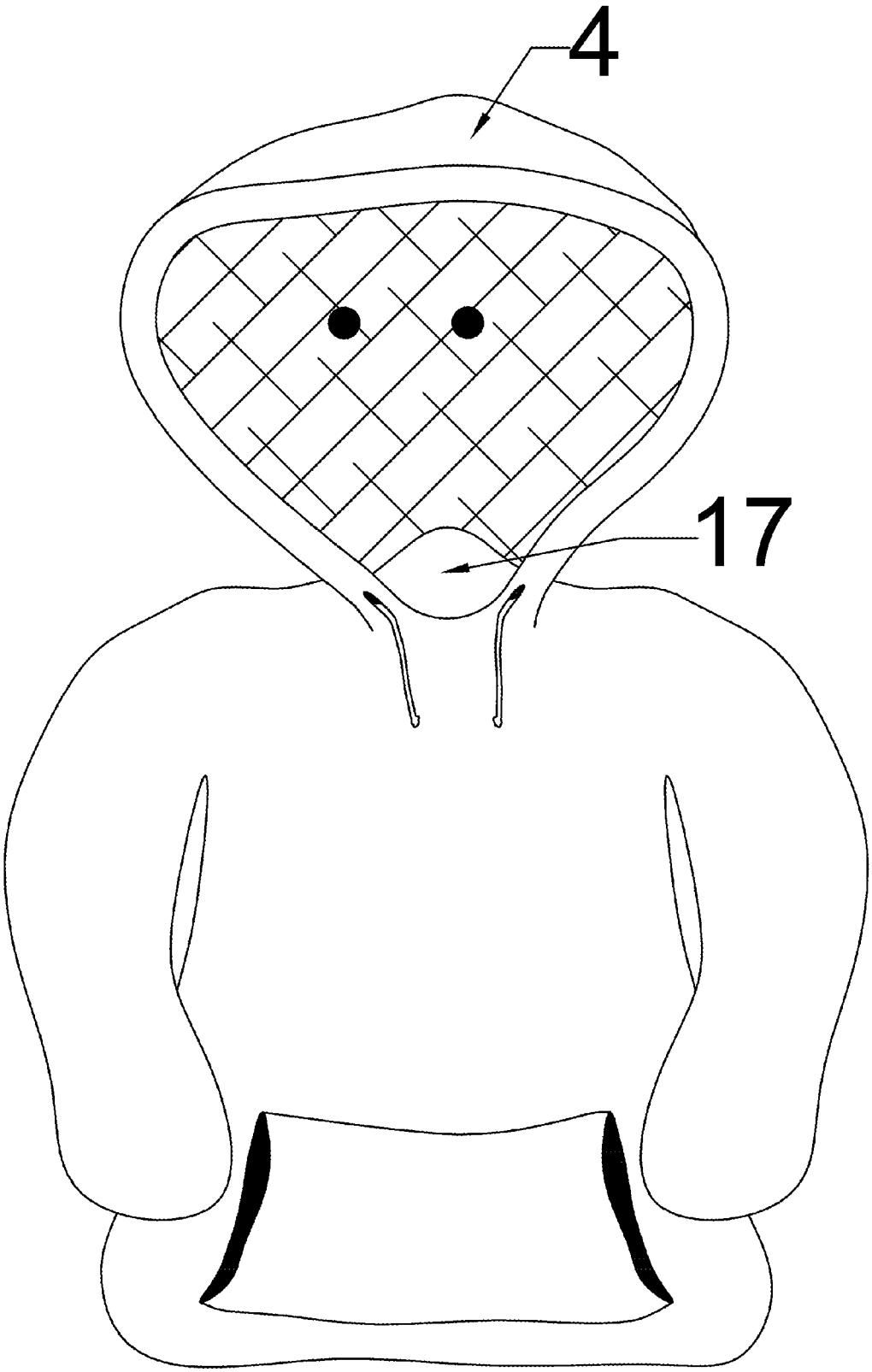
FIG. 4 shows a front view of a hoodie with an outside pocket and fold up wind breaker chin flap.
Figure 5:
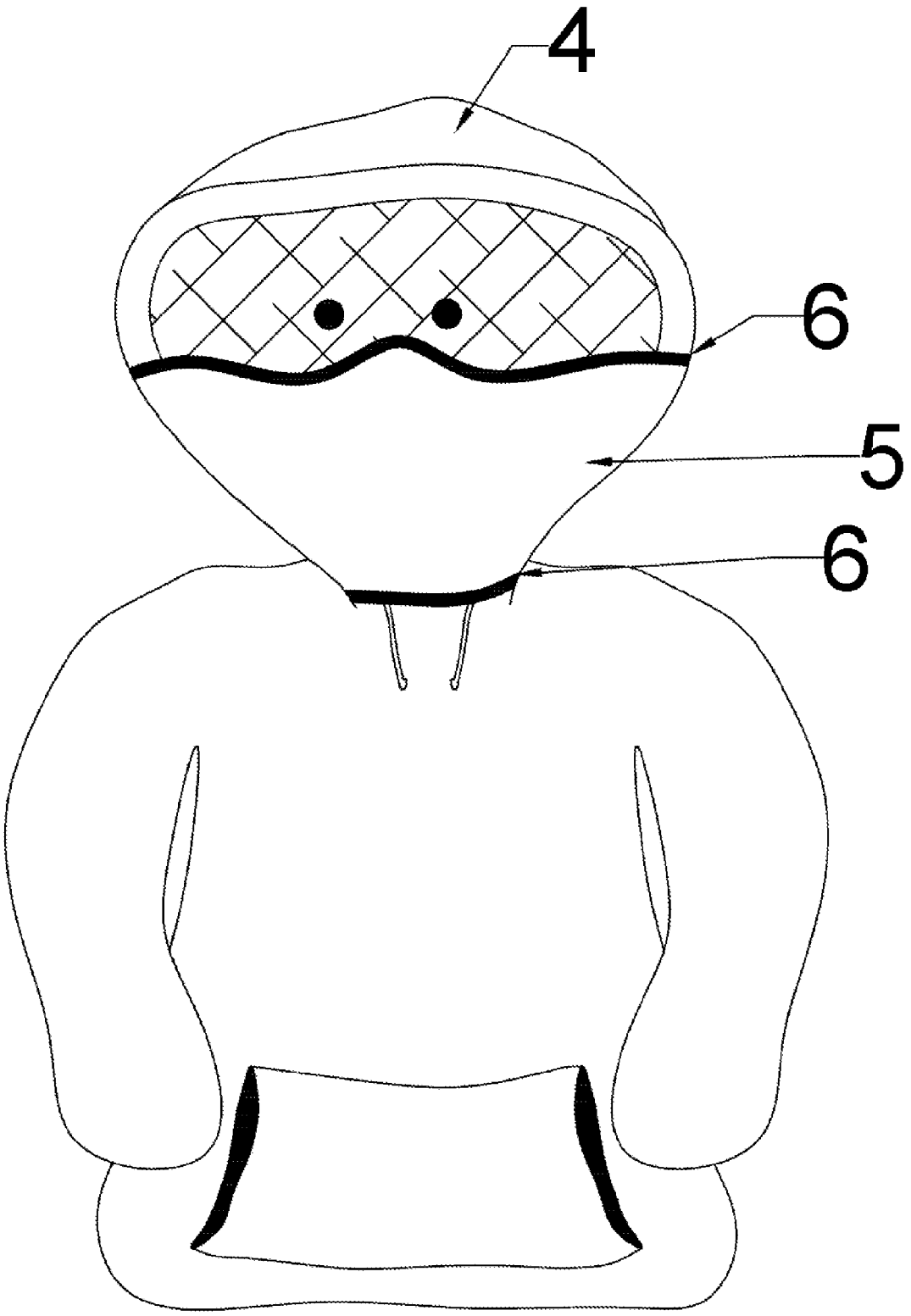
FIG. 5 shows a front view of a hoodie showing a tuck away face mask fully extended from outside pocket and anchored to opposite side.
Figure 6:
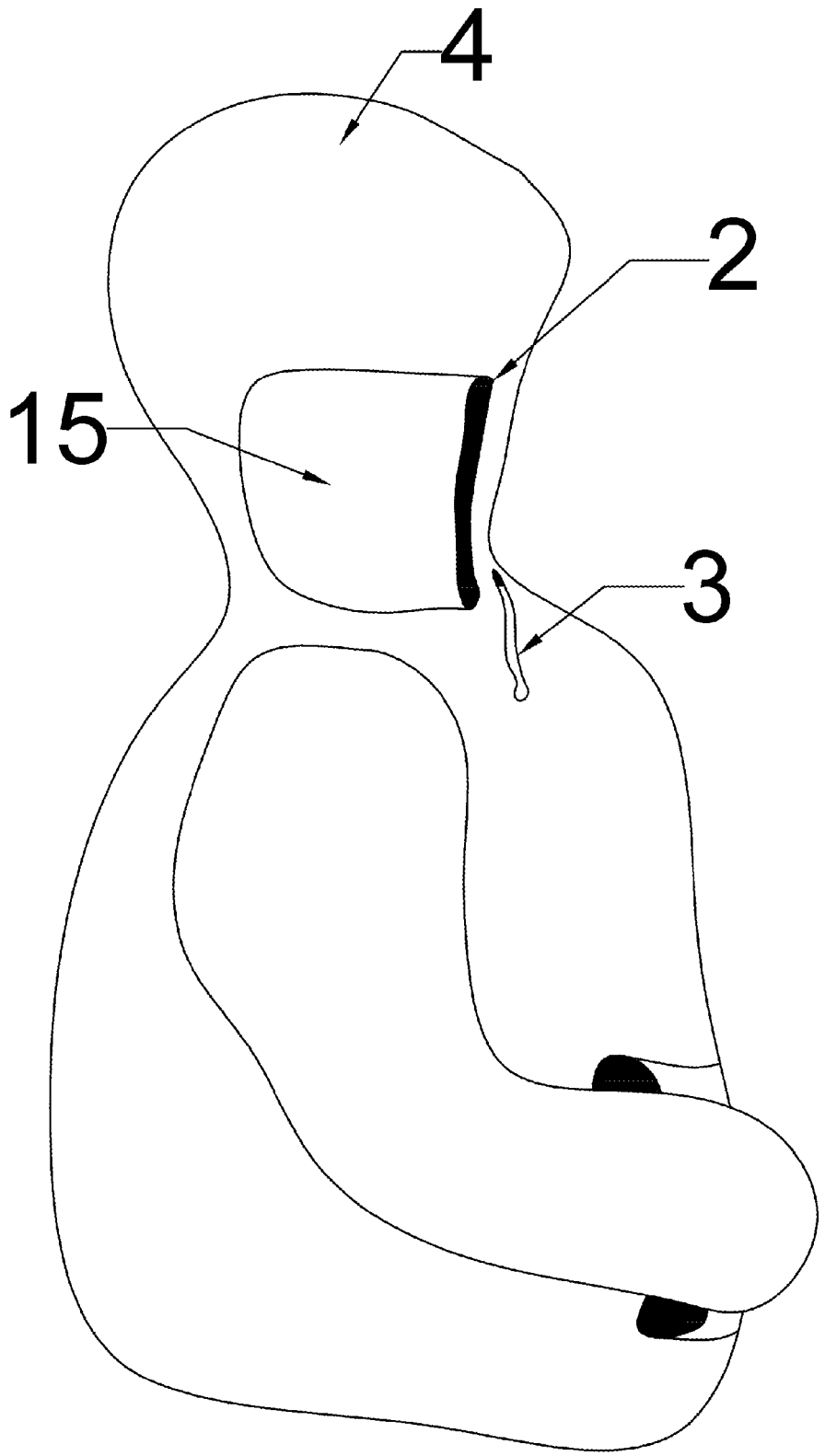
FIG. 6 shows a side view of a hoodie with an outside pocket for tuck away pull across face mask shown.

A hoodie with a fabric pocket attached to the outside of the hood is shown in FIGS. 5-6. The width of the pocket 15 and opening 2 is approximately 6-11 inches wide from top to bottom and 11-14 inches long front to back of the hood 4. The pocket 15 is located on the outside surface of the hood 4 just outside the front opening of the hood. The pocket's opening 2 faces front towards the opening of the hood. The tuck-away face mask 5 is approximately 6-11 inches wide and 11-14 inches in length. The tuck-away face mask 5 is attached to the outside surface of the hood 4 just inside the opening 2 of the outside pocket 15. The face mask 5 has its inside facing surface (surface in contact with the wearers face) lined with fleece and the outside facing surface of the mask consisting of the same material of the outer hood or some other variation of materials. The face mask 5 has a fastener at the unfixed end (right side in FIGS. 4 and 5) which can be of a variety of fastener types, for example hook and loop fastener (Velcro®), buttons, snap button, magnets, zipper, and self adhering fabric or polymer. The face mask 5 may have a top and bottom elastic band 6 for a more snug and tightened fit. The hood 4 has a face mask anchor fastener 18, 19, 20, 21, 29 on the outside or inside of the hood 4 opposite the fixed end of the face mask 5 and an anchor fastener cover flap 22 covering these anchor fasteners. Additionally, the hoodie has a fleece lined fold-up wind breaker chin flap 17 located at the bottom apex of the hood 4 opening between the draw strings 3. The chin flap 17 has a fleece lining on the inside surface (surface in contact with the wearer's face) and outside facing surface consisting of the same material of the outer hood or some other variation of materials.

Hoodie with Intermittent Lining Pocket

Figure 7:
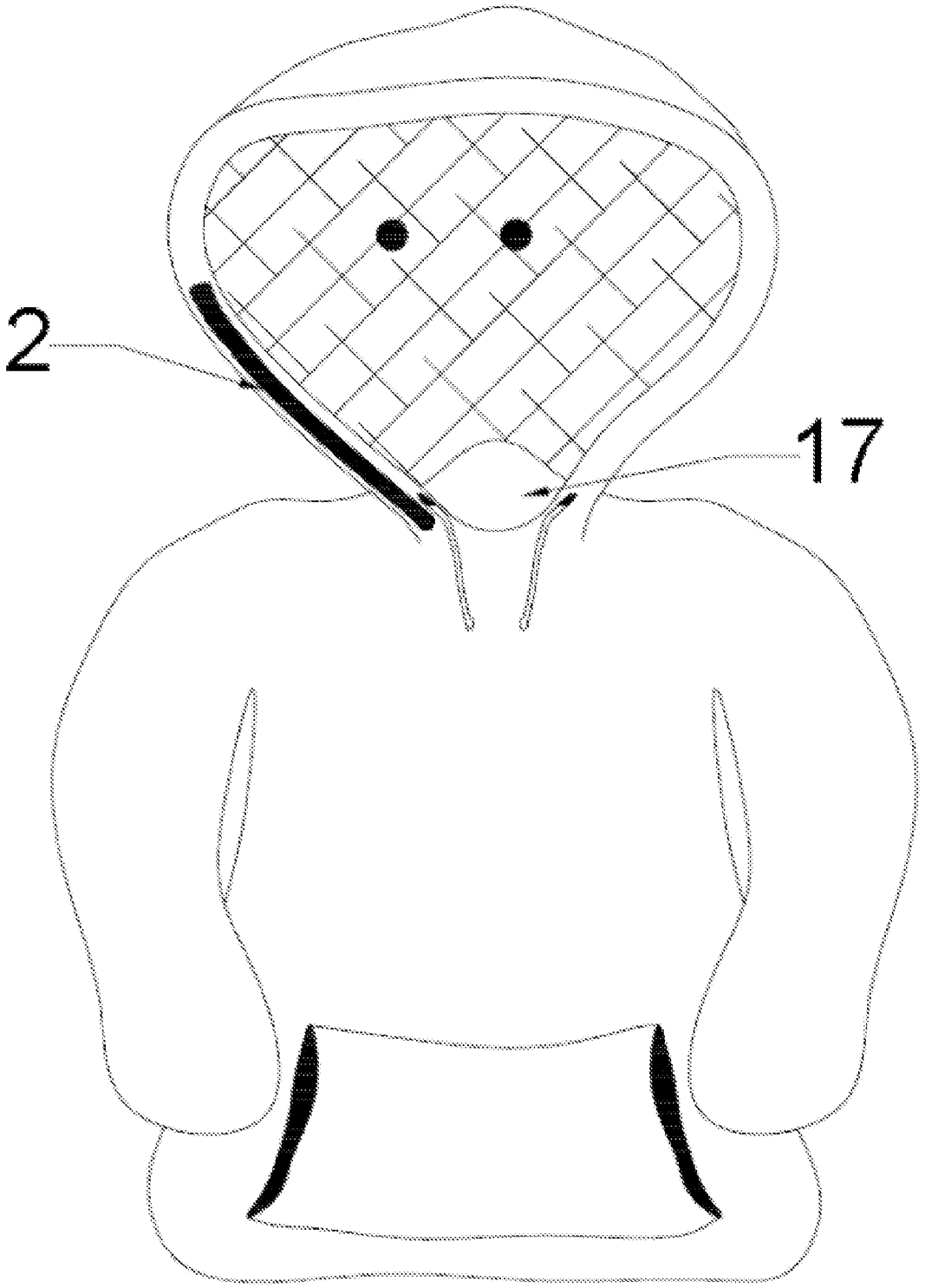
FIG. 7 shows a front view of a hoodie with an intermittent lining pocket and fold up wind breaker chin flap.
Figure 8:
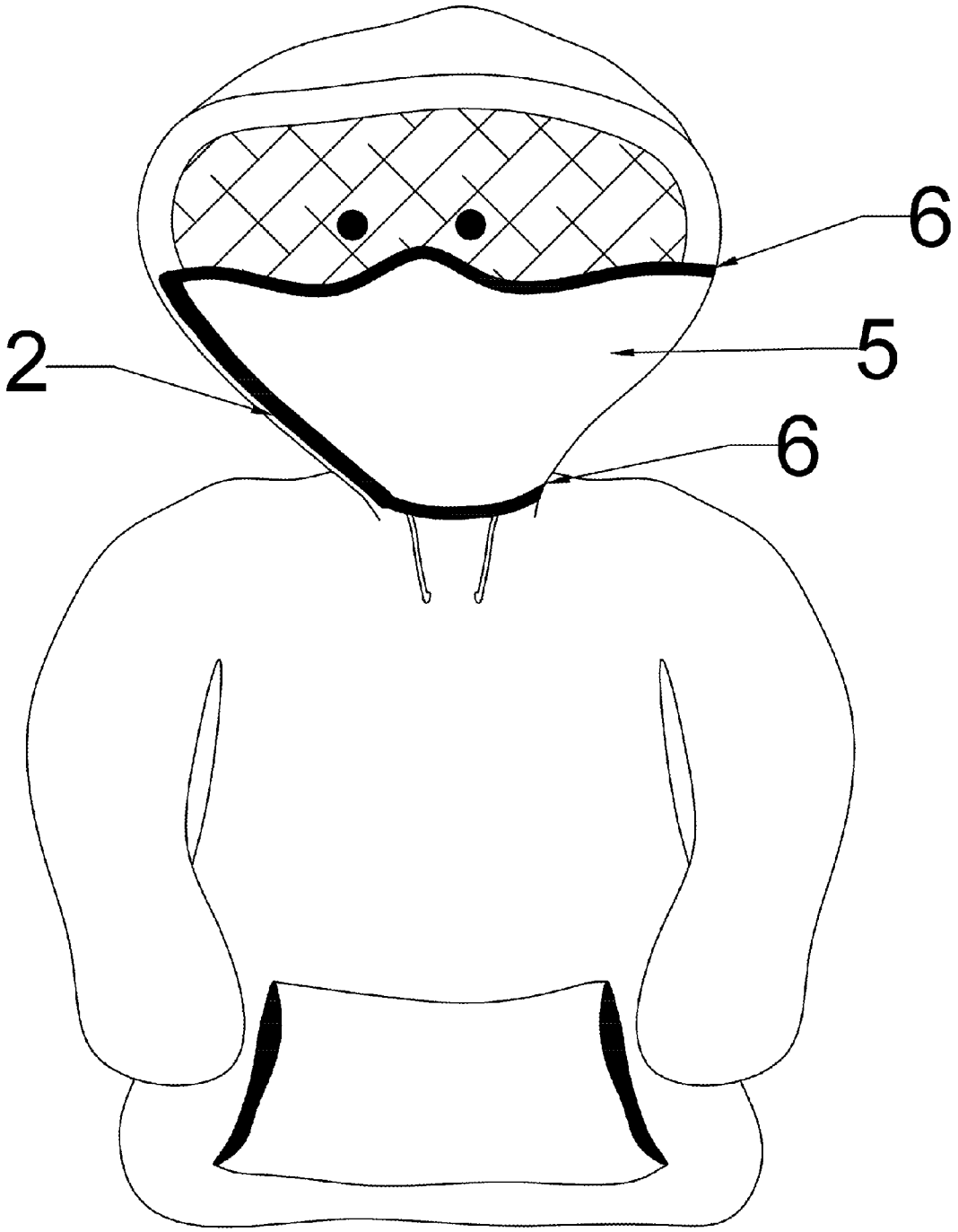
FIG. 8 shows a front view of a hoodie with an intermittent lining pocket showing tuck away face mask fully extended from intermittent lining pocket and anchored to opposite side.
Figure 9:
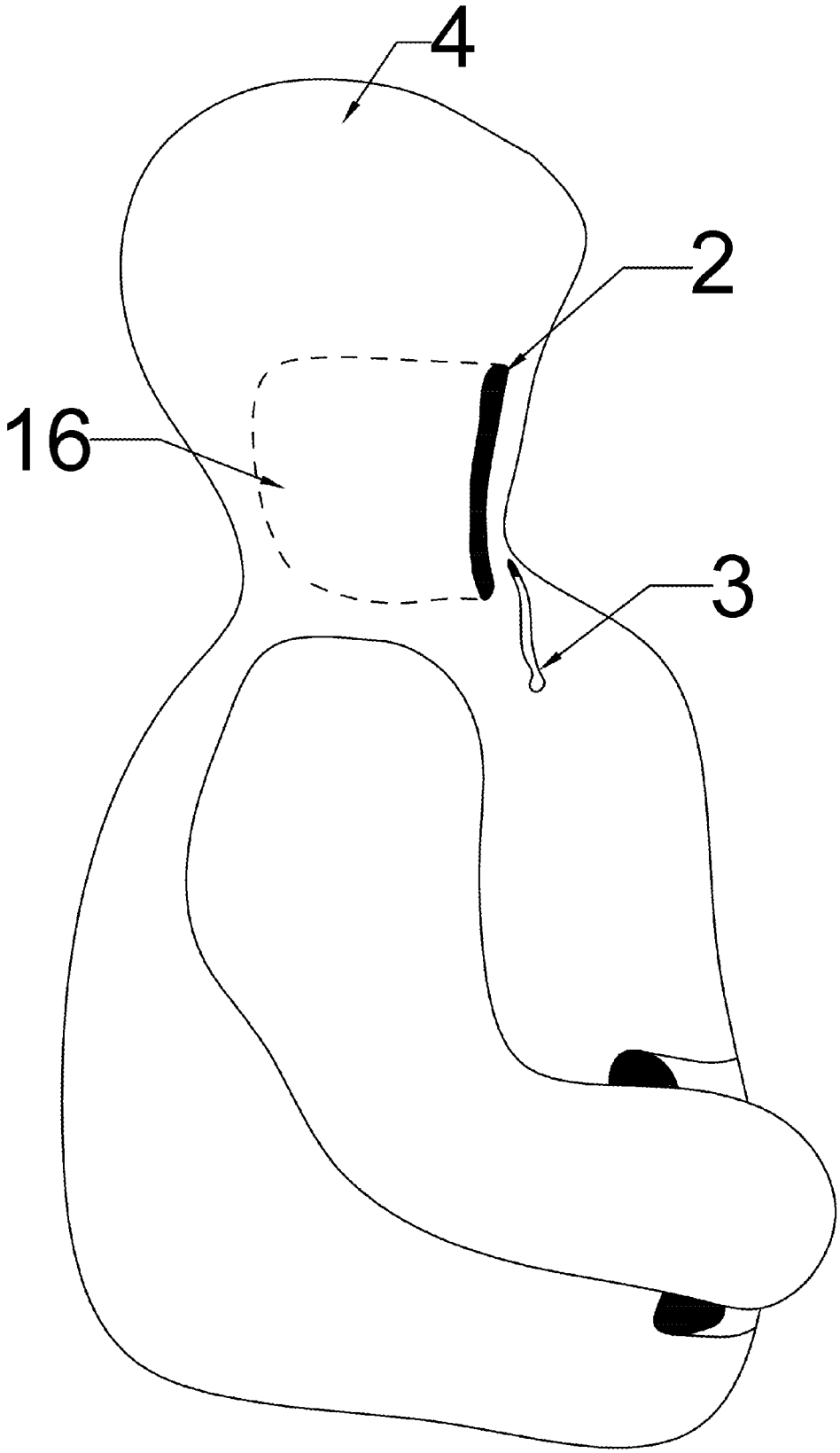
FIG. 9 shows a side view of a hoodie with an intermittent lining pocket shown with hatch line.
Figure 10:
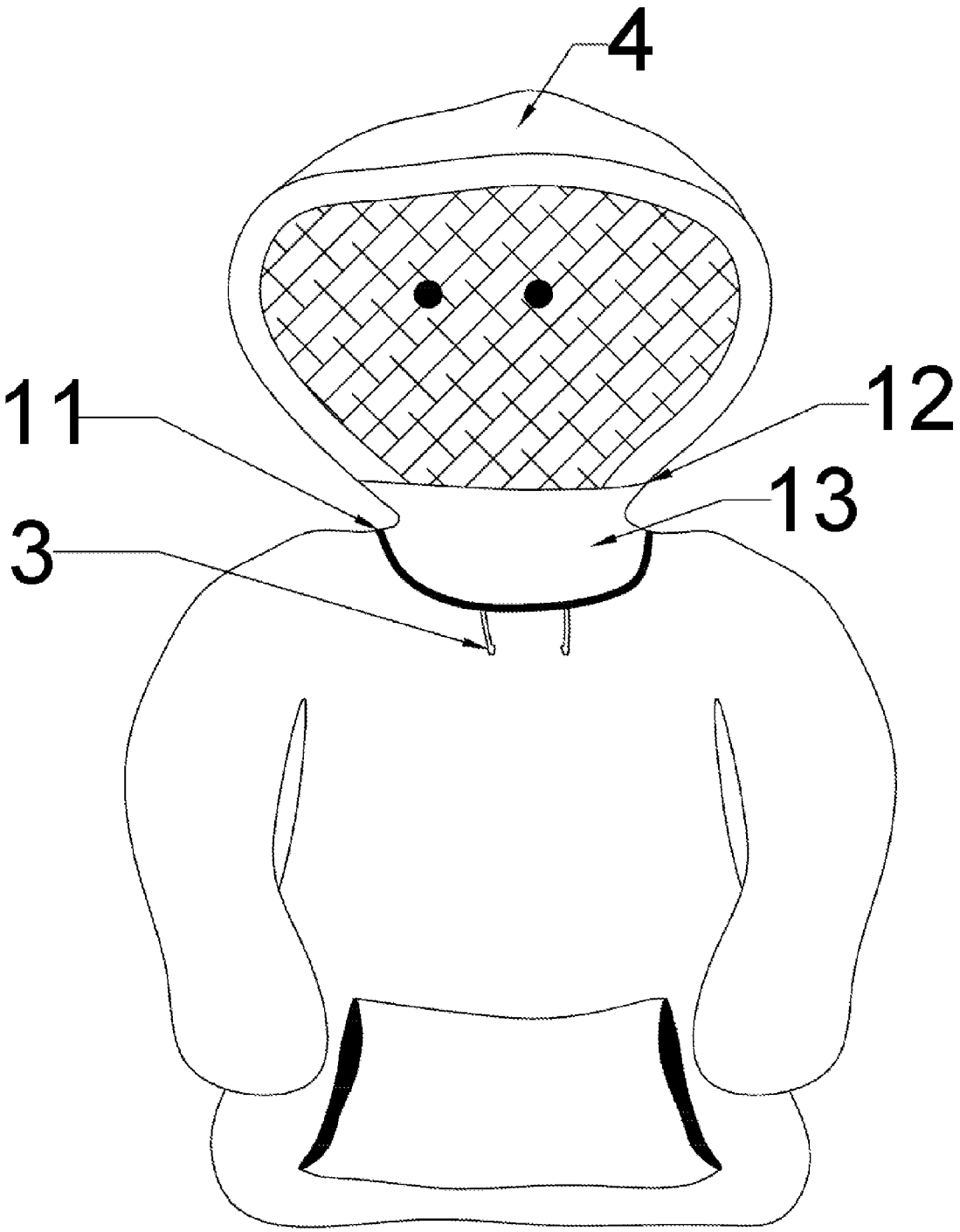
FIG. 10 shows a front view of a hoodie with a fold up collar face mask folded down.

A hoodie with a fabric pocket 16 placed in between the outer hood and inner hood lining is shown in FIGS. 7-9. The width of the pocket 16 and opening 2 is approximately 6-11 inches wide from top to bottom and 11-14 inches long front to back of the hood. The pocket 16 opening is located on the inside or outside surface or right on the front seam line of the hood 4. The pocket 16 is placed just inside or outside the front opening of the hood. The pocket's 16 opening 2 faces front towards the opening of the hood 4. The tuck-away face mask 5 is approximately 6-11 inches wide and 11-14 inches in length. The tuck-away face mask 5 is attached to the inside lining of the hood 4 just outside the opening of the intermittent pocket opening, when the pocket opening 2 is on the inside of the hood, and is attached to the outside surface of the inner hood 4 lining just inside the opening 2 of the pocket when the pocket opening is on the outside of the hood 4. The face mask 4 has its inside facing surface (surface in contact with the wearer's face) lined with fleece and the outside facing surface of the mask 5 consisting of the same material of the outer hood or some other variation of materials. The face mask 5 has a fastener at the unfixed end which can be a variety of fastener types but more commonly hook and loop fasteners (Velcro®), buttons, snap buttons, magnets, a zipper, and self adhering fabric. The face mask 5 may have a top and bottom elastic band 6 for a more snug and tightened fit. The hood 4 has a face mask anchor fastener 18, 19, 20, 21, 29 on the outside or inside of the hood opposite the fixed end (right side in FIGS. 7-9) of the face mask 5 and an anchor fastener cover flap 22 covering these anchor fasteners. Additionally the hoodie has a fleece lined fold up wind breaker chin flap 17 located at the bottom apex of the hood opening between the draw strings 3. The chin flap 17 has fleece lining on the inside surface (surface in contact with the wearers face) and outside facing surface consisting of the same material of the outer hood or some other variation of materials.

Figure 28:
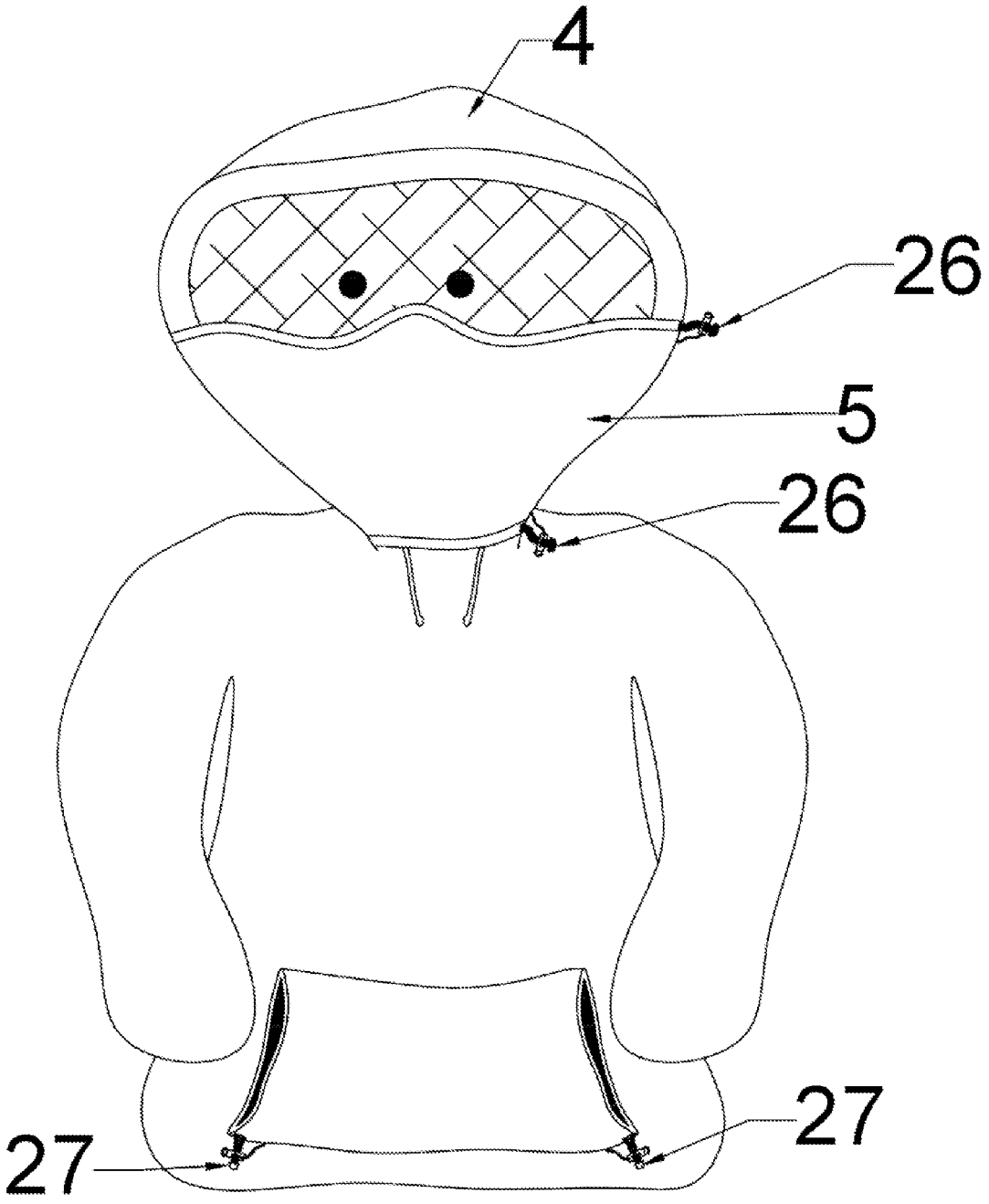
FIG. 28 shows a front view of a hoodie showing a tuck-away face mask fully extended from an outside pocket and anchored to the opposite side of the hood with elastic tightening draw strings, on upper and lower face mask edges, having pouch pockets.
Figure 29:
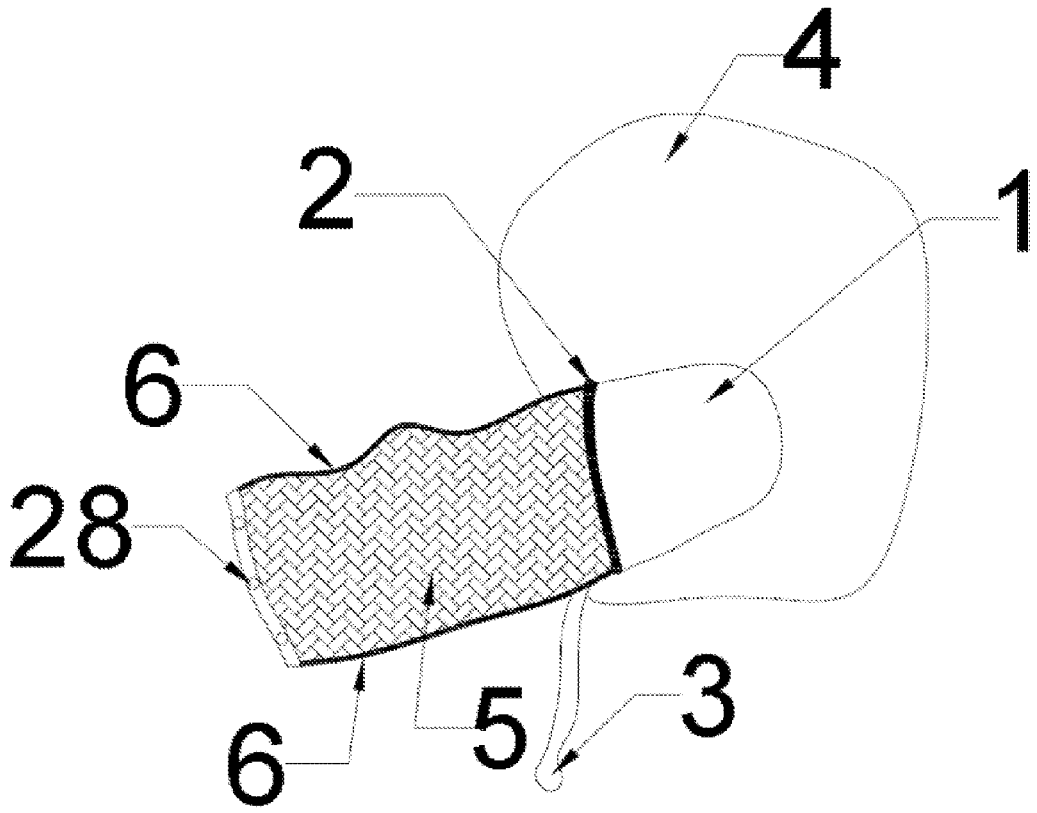
FIG. 29 shows an inside cross section view of a hood with an inside pocket showing a tuck-away face mask fully extended from inside pocket, having a magnetic fastener system.
Figure 30:
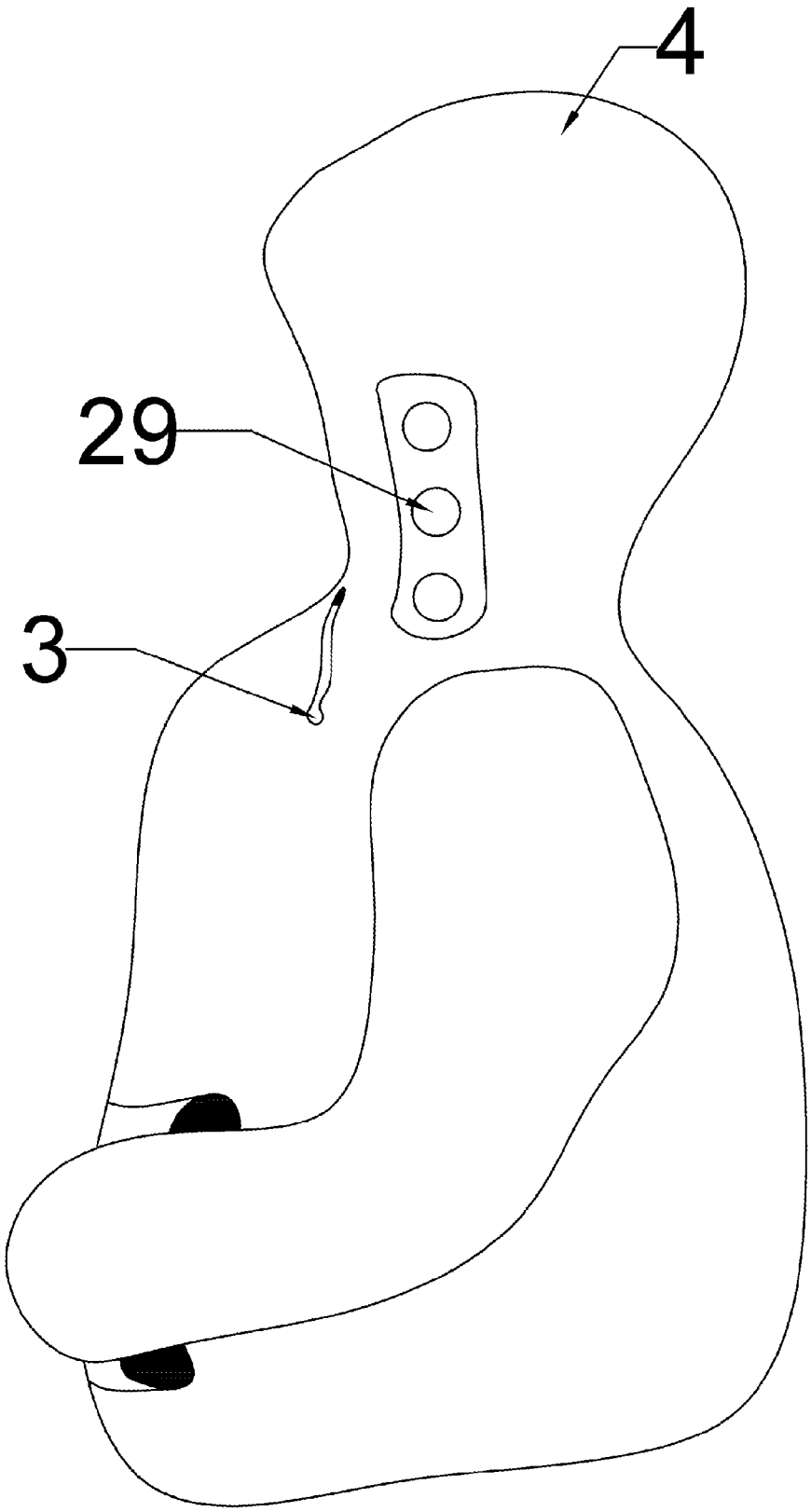
FIG. 30 shows a side view of a hoodie with a magnetic fastener anchor.

Regardless of the pocket structure, the face mask 5 may also have an elastic draw string with spring loaded locks 27 on upper and lower edges instead of simple elastic bands 6, as shown in FIG. 28. The spring loaded locks 27 may also form part of the attachment of the face mask 5 across the face.

Figure 17:
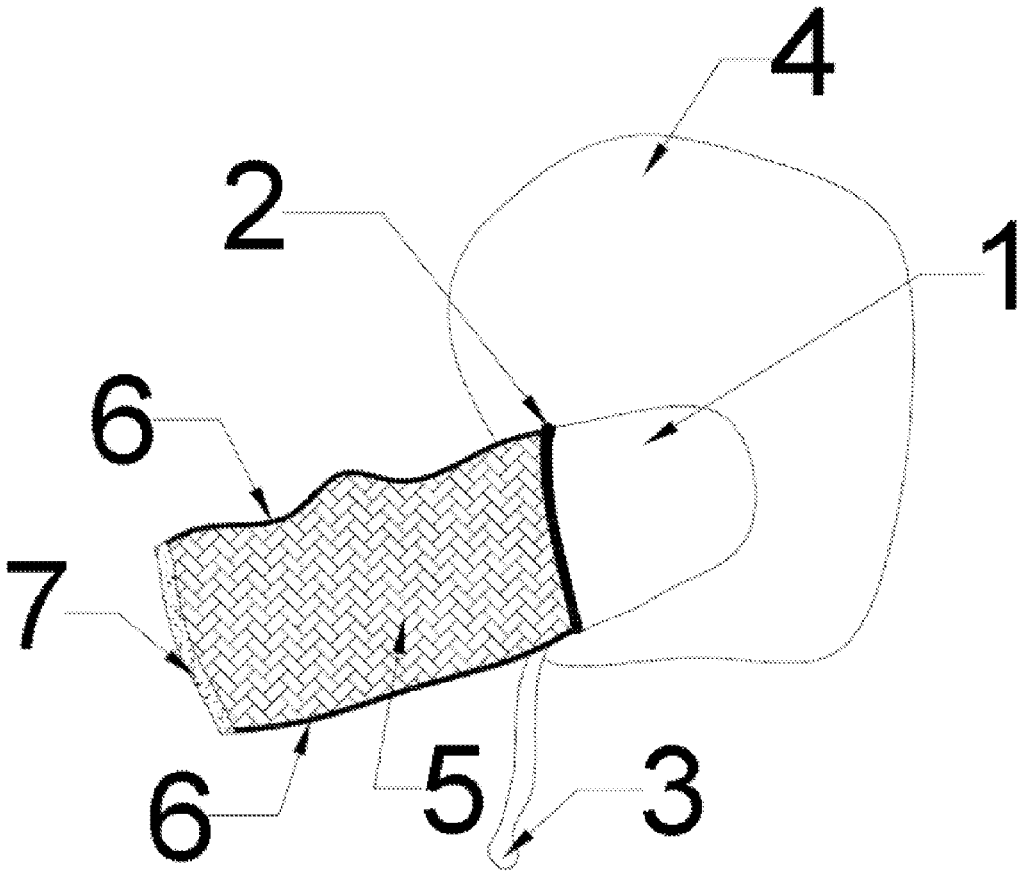
FIG. 17 shows an inside cross section view of a hoodie with an inside pocket showing a tuck-away face mask fully extended from an inside pocket with a hook and loop (e.g., Velcro®) fastener.
Figure 18:
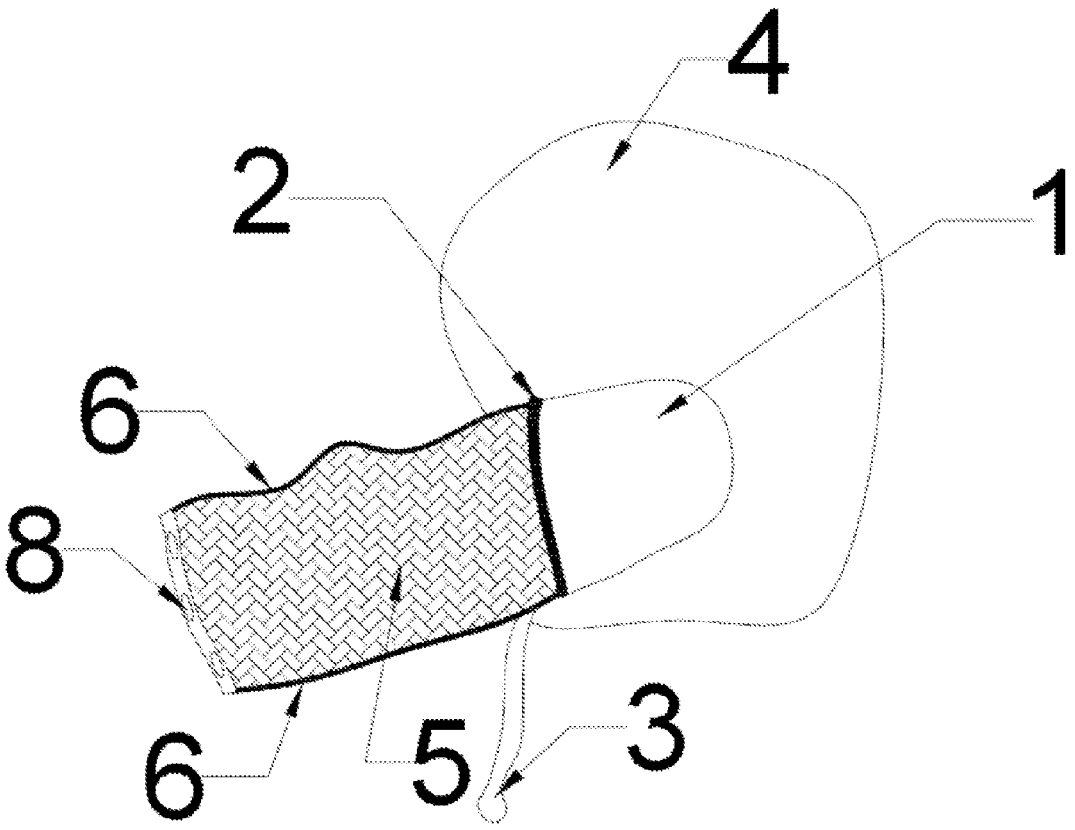
FIG. 18 shows an inside cross section view of a hoodie with an inside pocket showing a tuck away face mask fully extended from the inside pocket, with a button hole fastener.
Figure 19:
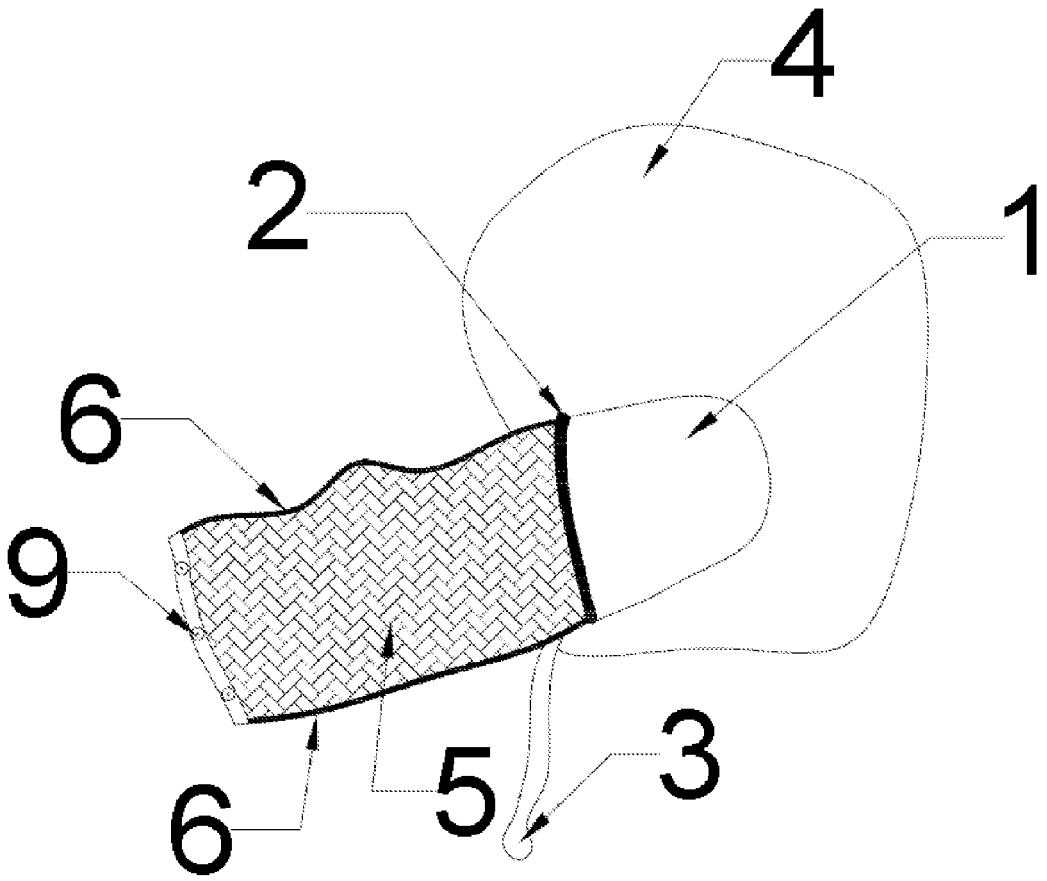
FIG. 19 shows an inside cross section view of a hoodie with an inside pocket showing a tuck-away face mask fully extended from the inside pocket, with a snap button fastener.
Figure 20:
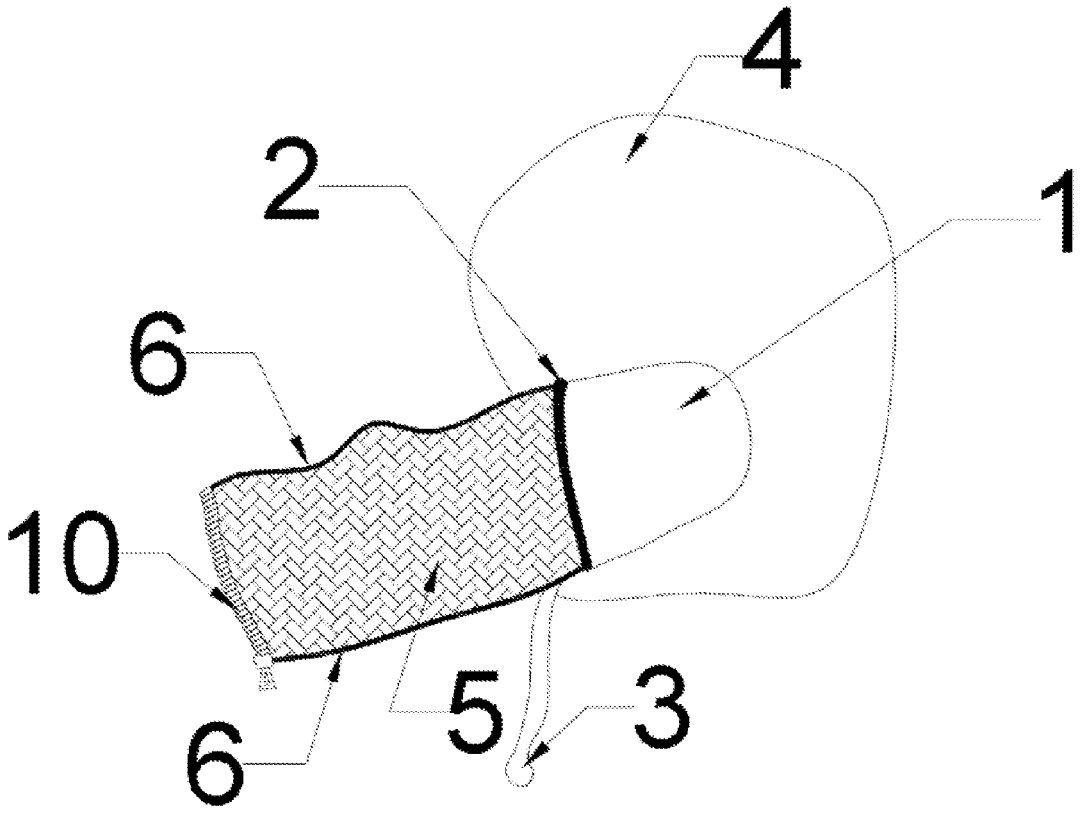
FIG. 20 shows an inside cross section view of a hoodie with an inside pocket, showing a tuck-away face mask fully extended from the inside pocket, with a zipper fastener.
Figure 21:
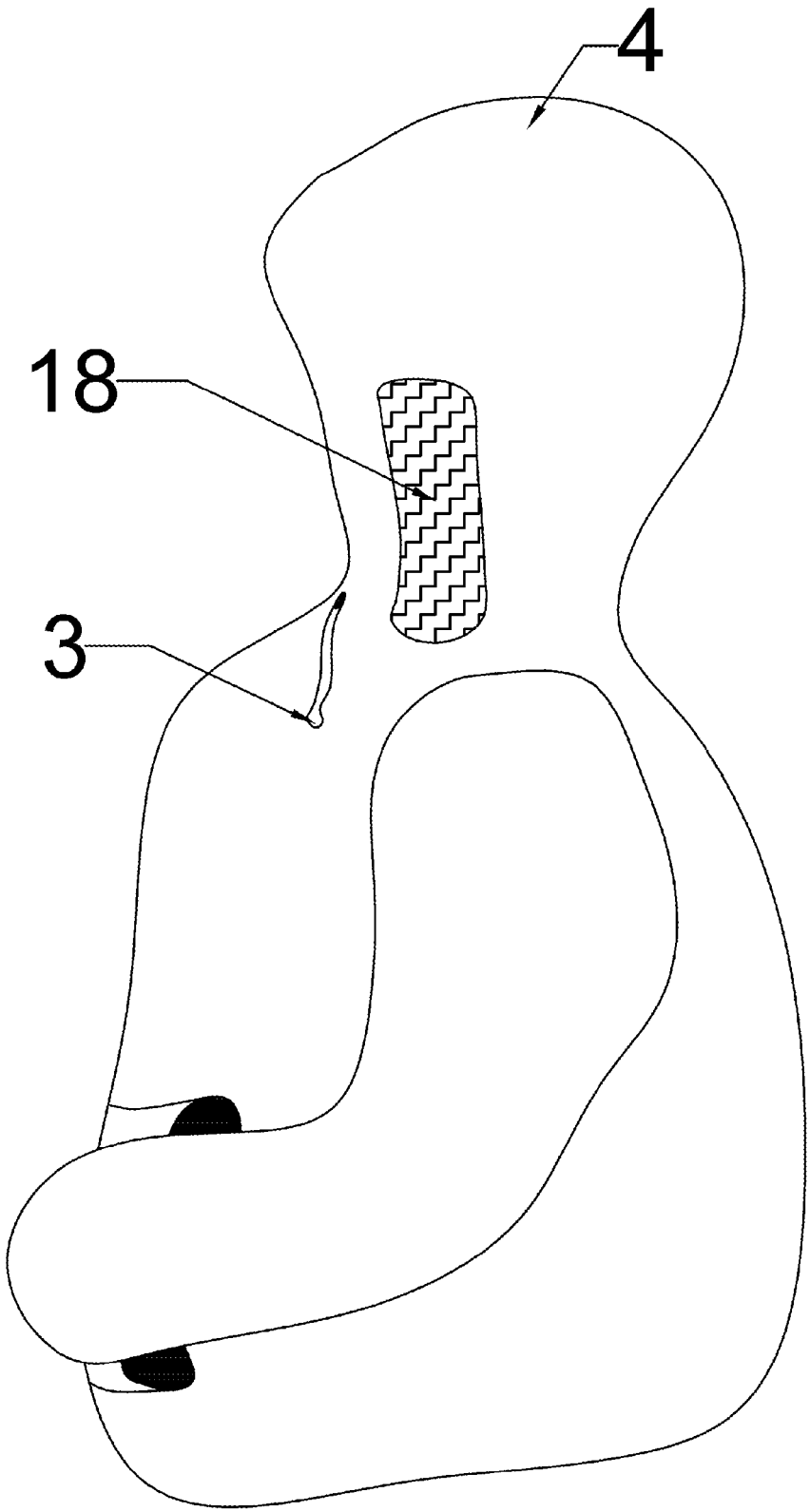
FIG. 21 shows a side view of a hoodie with a hook and loop (Velcro®) fastener anchor.
Figure 22:
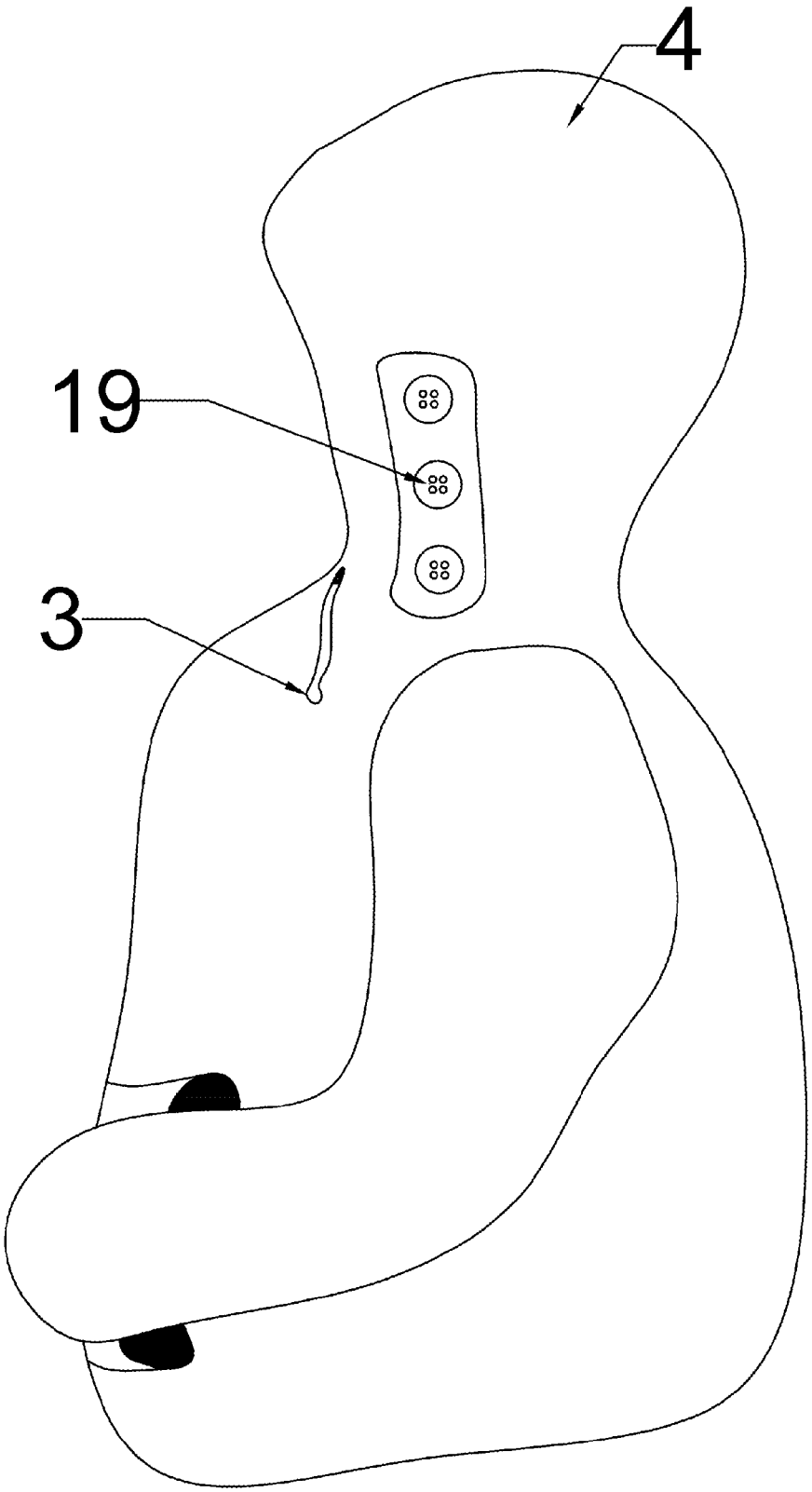
FIG. 22 shows a side view of a hoodie with a button fastener anchor.
Figure 23:
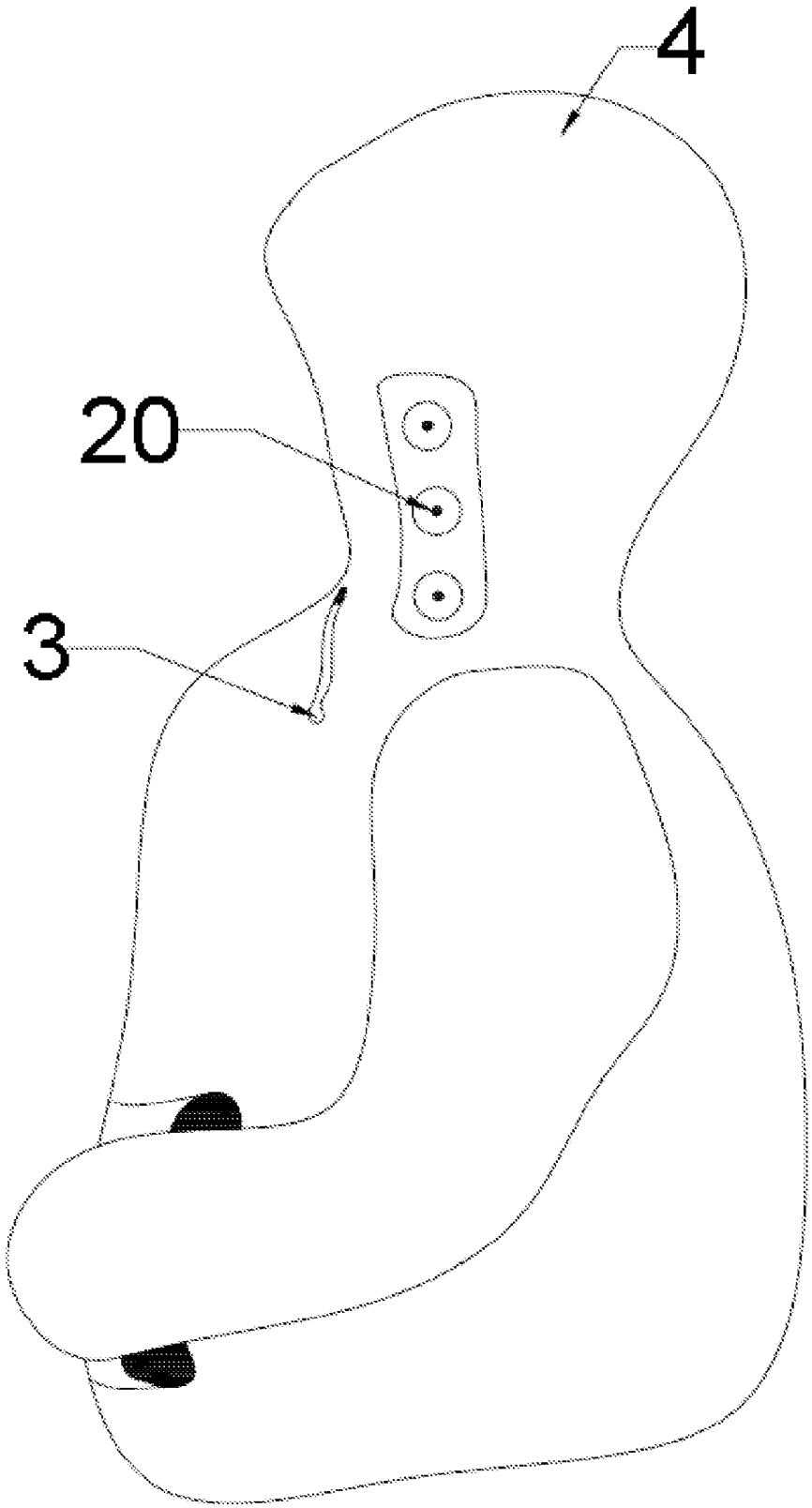
FIG. 23 shows a side view of a hoodie with a snap button fastener anchor.
Figure 24:
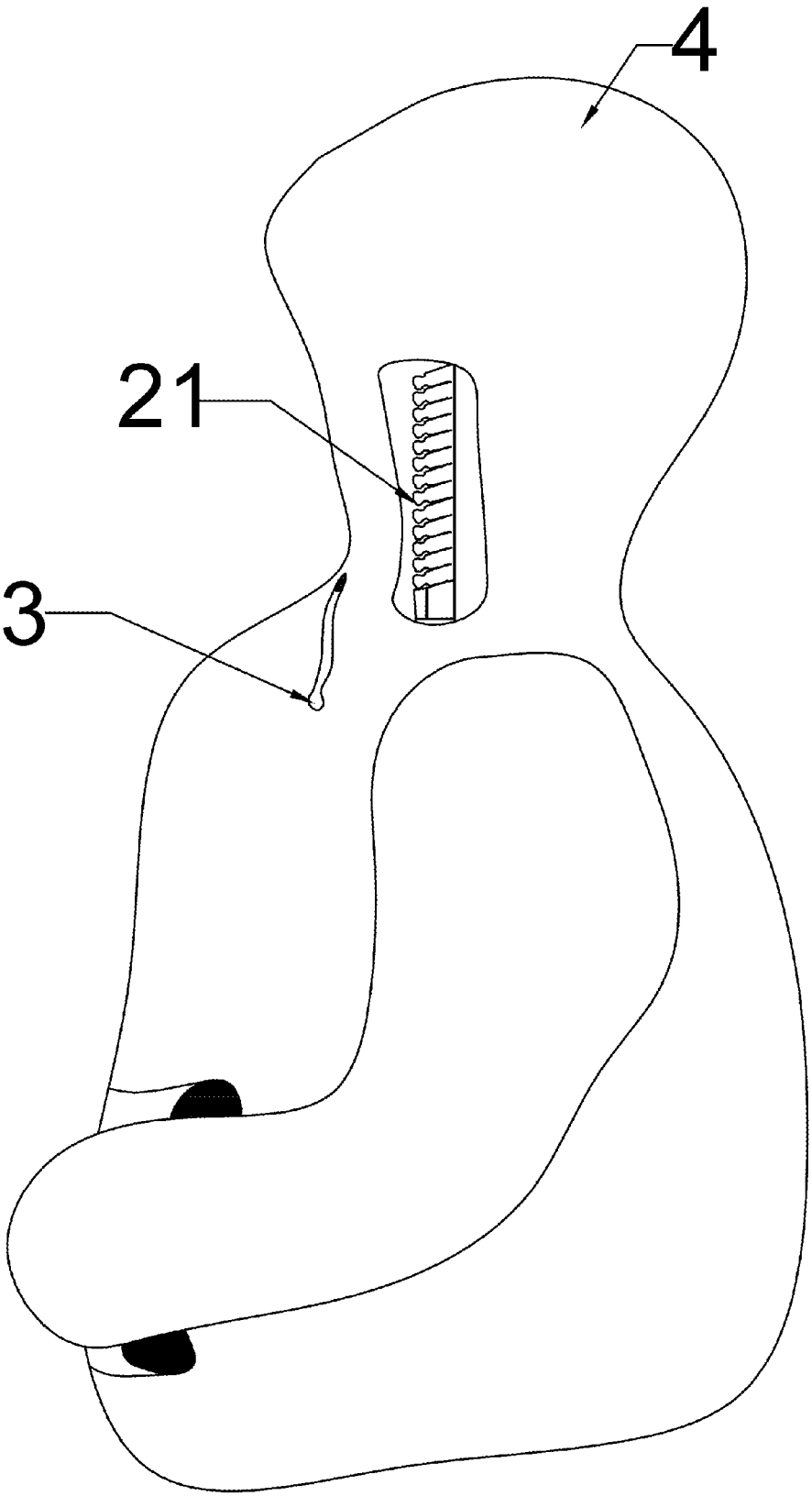
FIG. 24 shows a side view of a hoodie with a zipper fasten anchor.
Figure 25:
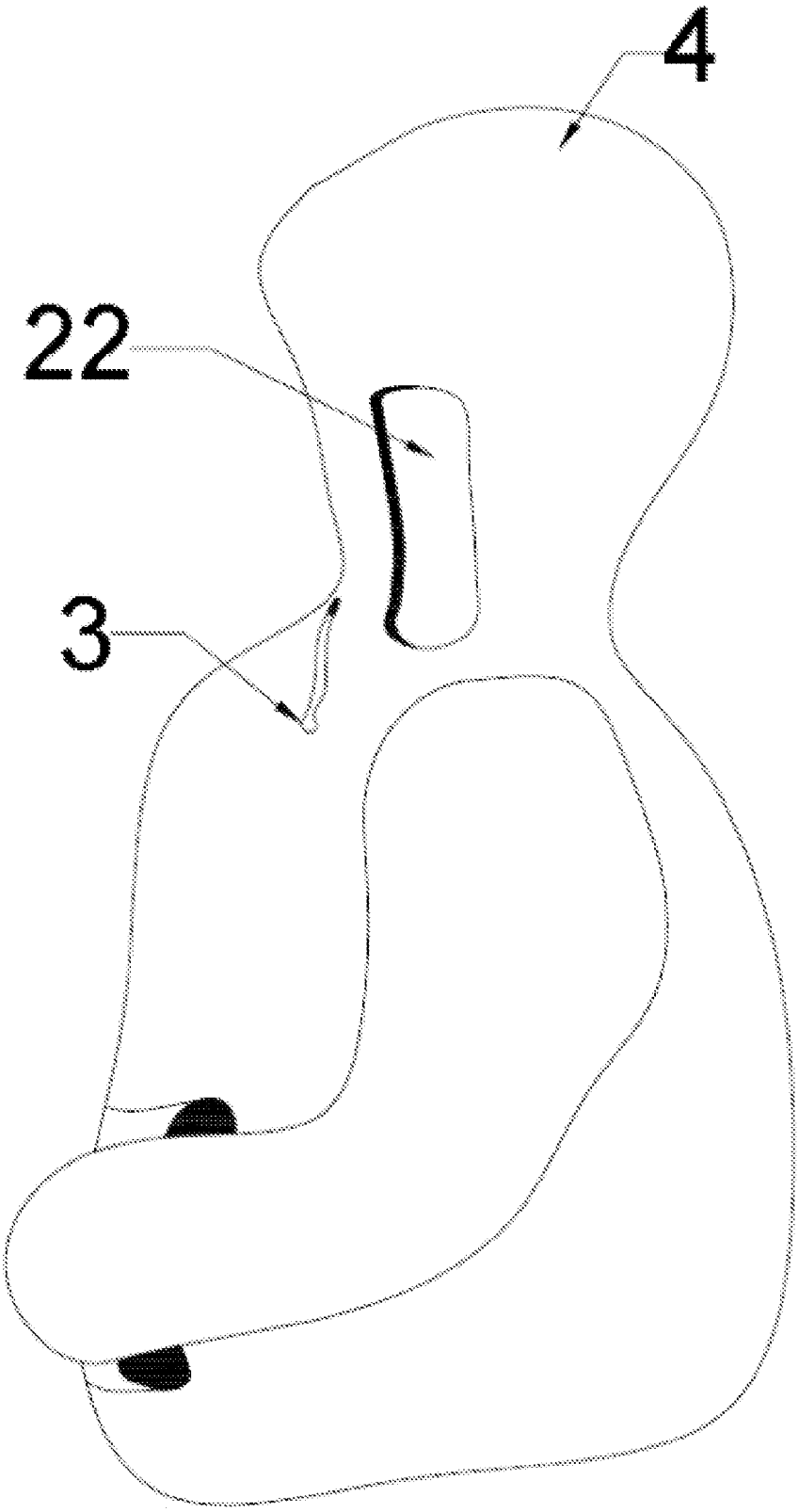
FIG. 25 shows a side view of a hoodie with a fastener anchor-hiding fabric cover flap.

FIGS. 17 and 21 show the attachment of the face mask 5 by hook and loop fastener material (e.g., Velcro®) 7, 18.

Hoodie with Fold Up Collar Face Mask

Figure 11:
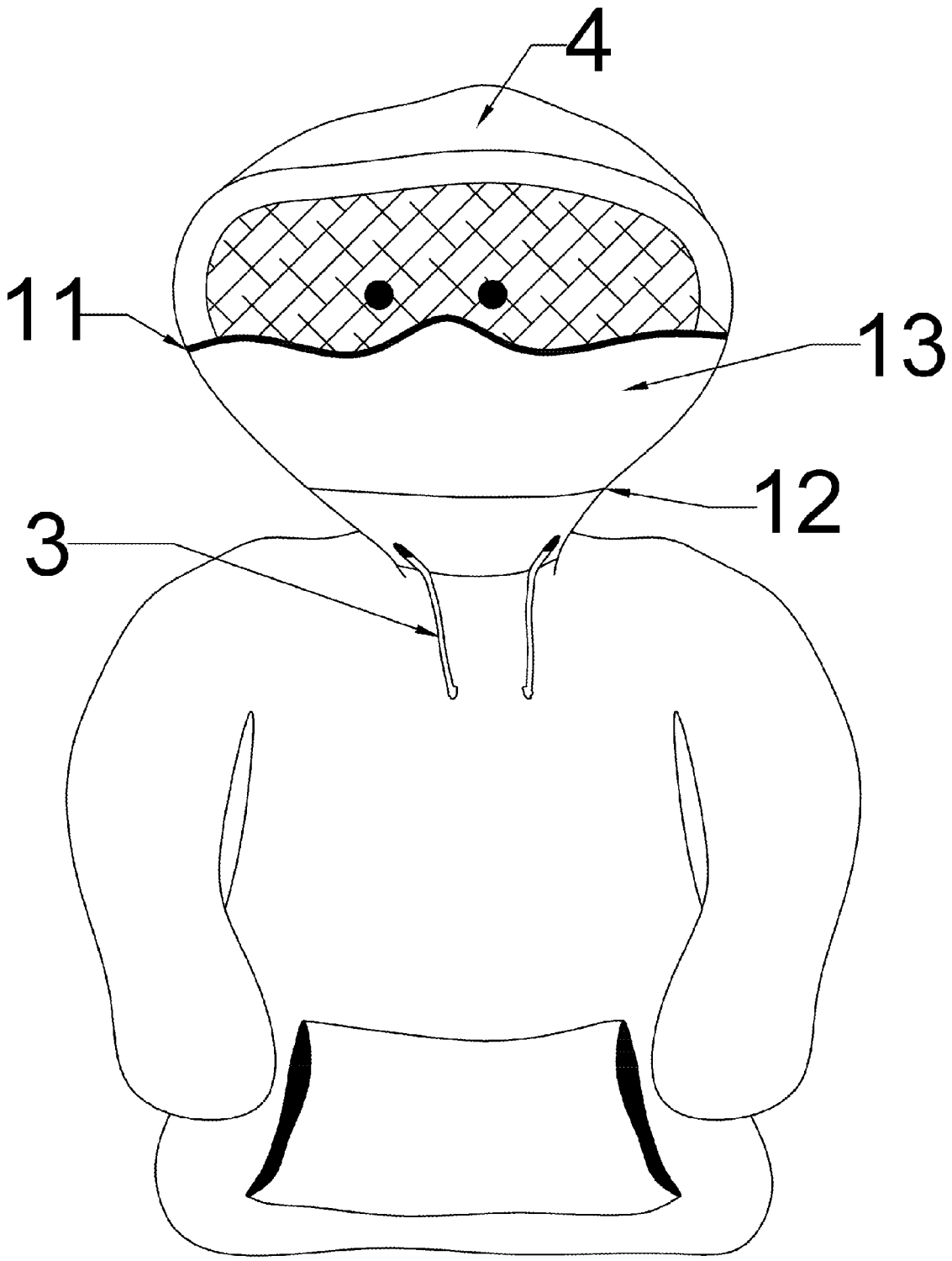
FIG. 11 shows a front view of a hoodie with a fold up collar face mask folded up.
Figure 12:
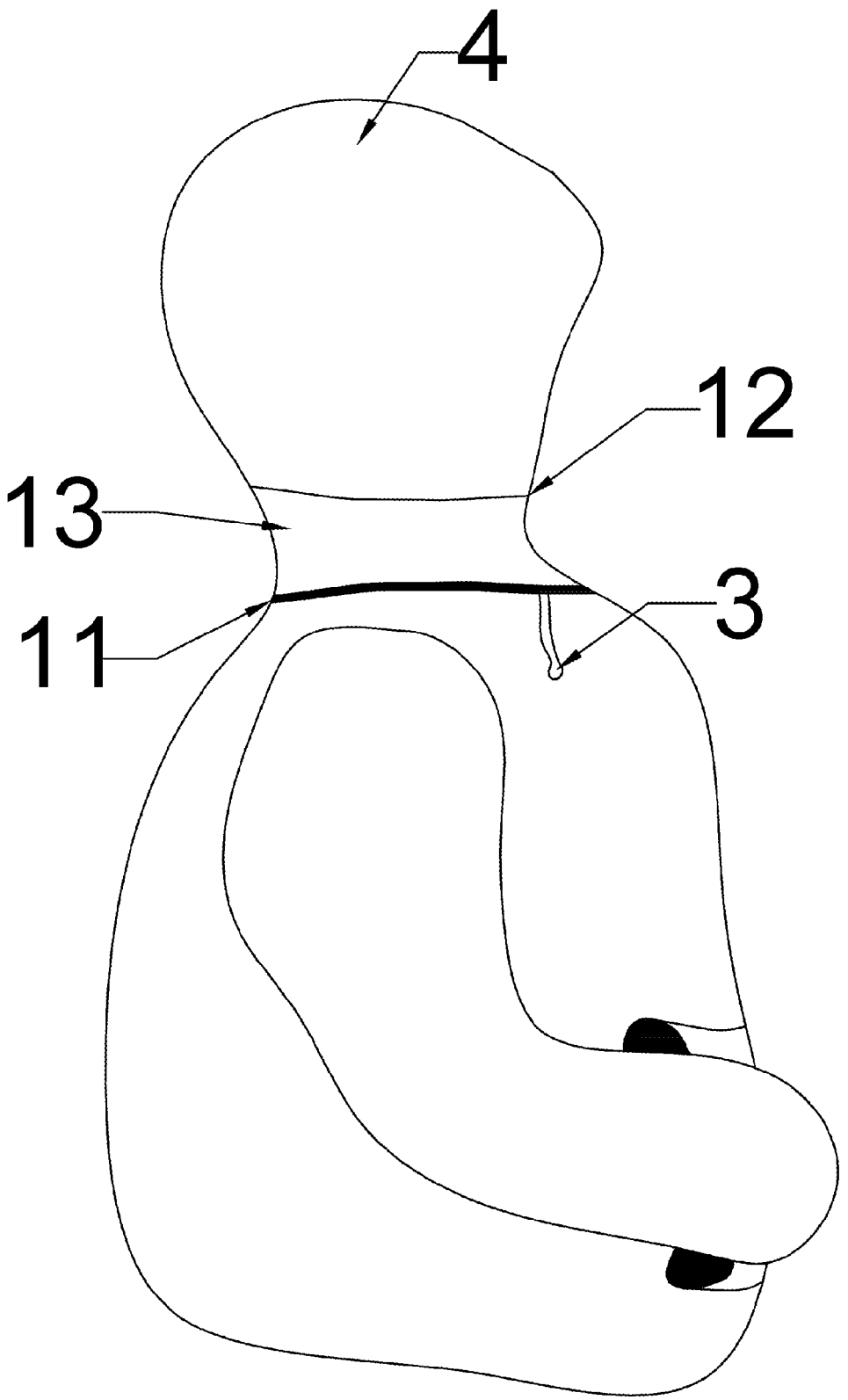
FIG. 12 shows a side view of a hoodie with a fold up collar face mask folded down.
Figure 13:
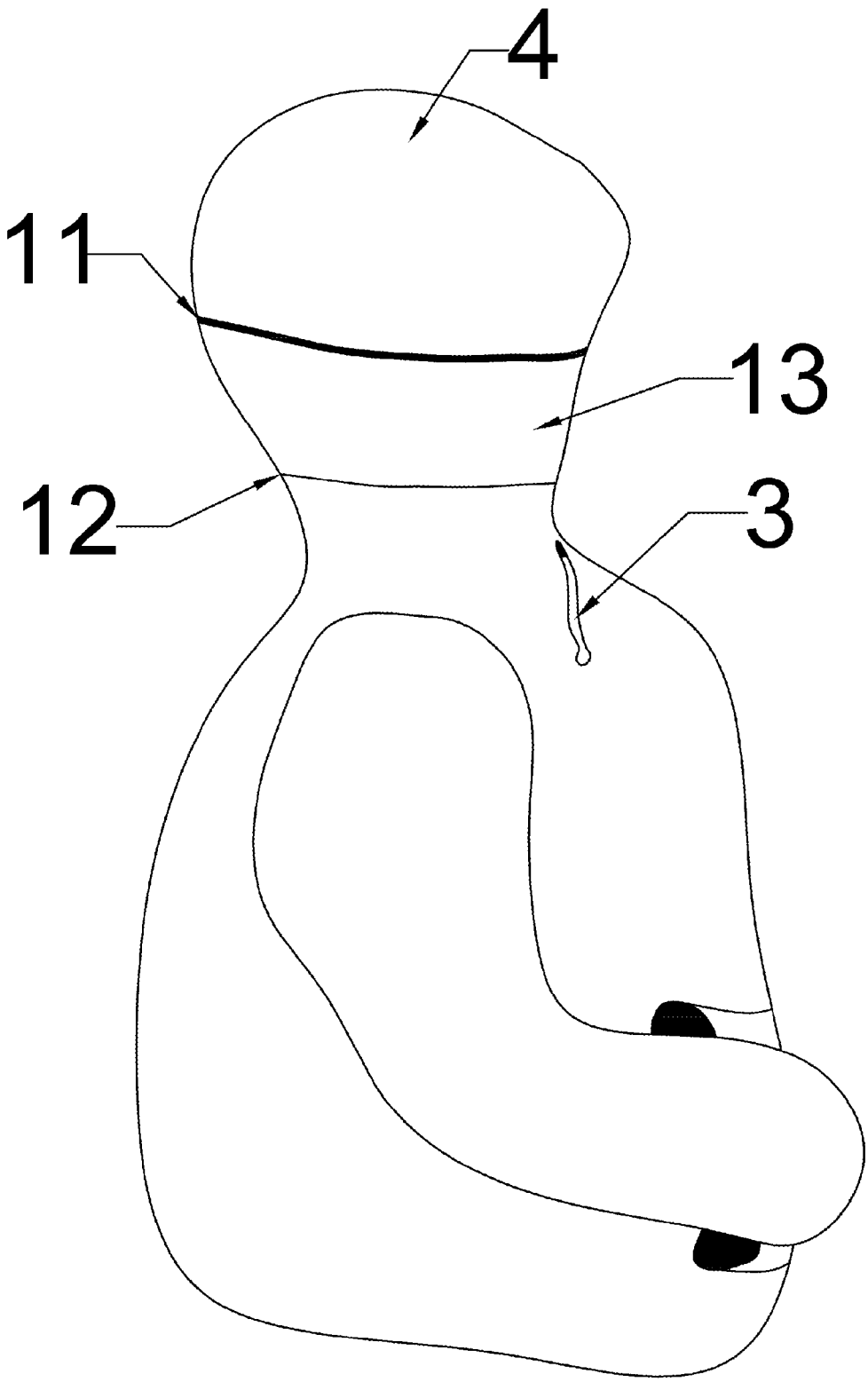
FIG. 13 shows a side view of a hoodie with a fold up collar face mask folded up.

A hoodie with a full 360 degree fold-up collar face mask is shown in FIGS. 10-13. The width or height of the fold-up face mask 13 is approximately 6-12 inches wide from top to bottom (from top of mask 13 down to stabilizing anchor stitch fold line 12). The collar face mask 13 has a stabilizing anchor stitch fold 12 line approximately 8-10 inches the way down from the top of the face mask 13 when in the folded up position the full 360 degrees around the hoodie neck, as shown in FIGS. 11 and 13. The fold up collar face mask 13 has an elastic band 11 located at the top of the face mask 13 the full 360 degrees around, for snug and tightened fit and to keep the collar down and snug to the collar when in the folded down position, shown in FIGS. 10 and 12. The face mask 13 has its inside facing surface (surface in contact with the wearer's face) lined with fleece and the outside facing surface of the mask consisting of the same material of the outer hood or some other variation of materials. The fold up collar face mask may have an elastic draw string with spring loaded locks (not shown in FIGS. 10-13) instead of the elastic band 11.

Hoodie with Hidden Fold Down Face Mask

Figure 14:
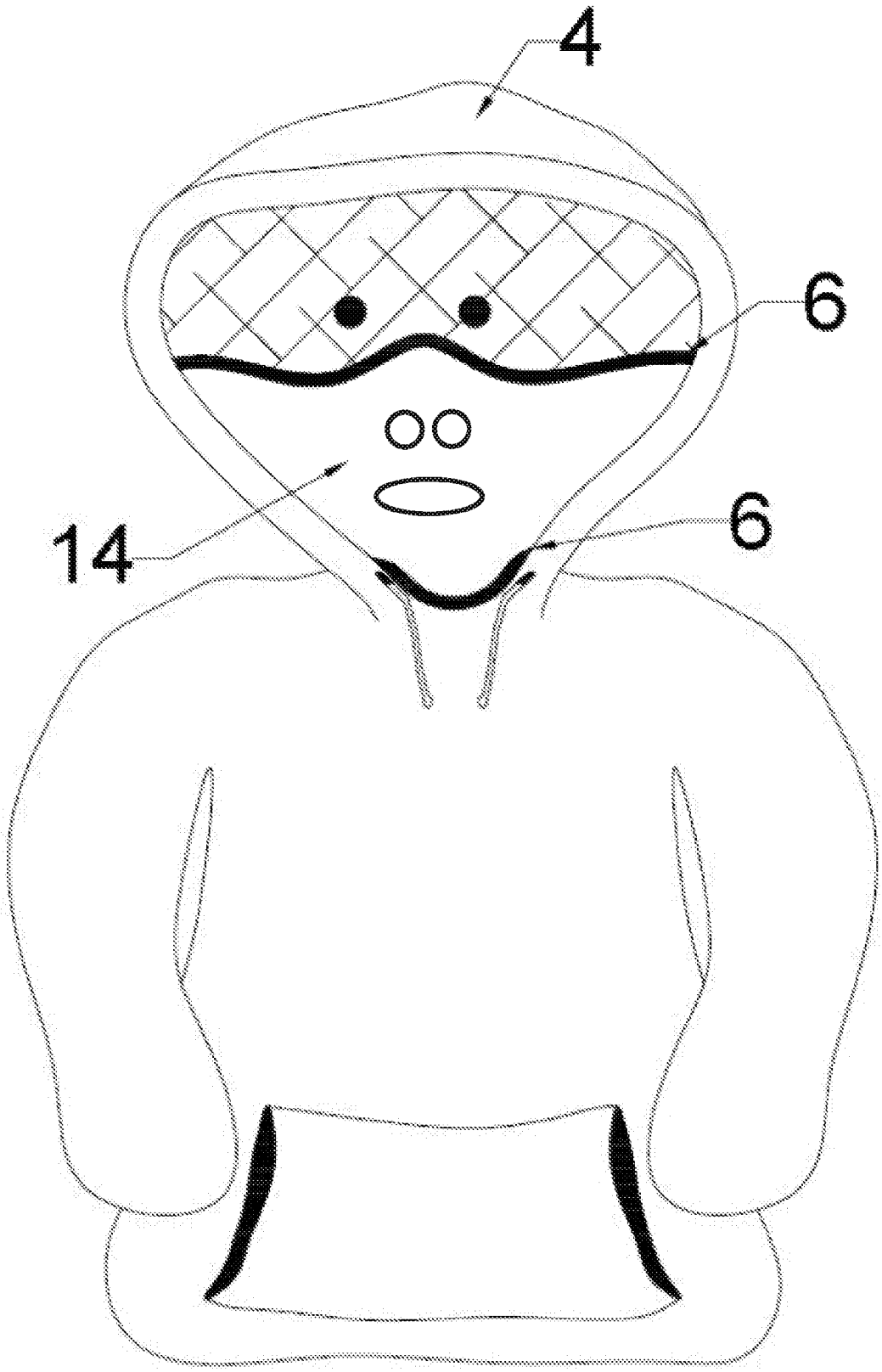
FIG. 14 shows a front view of a hoodie with a hidden fold down face mask folded down.
Figure 15:
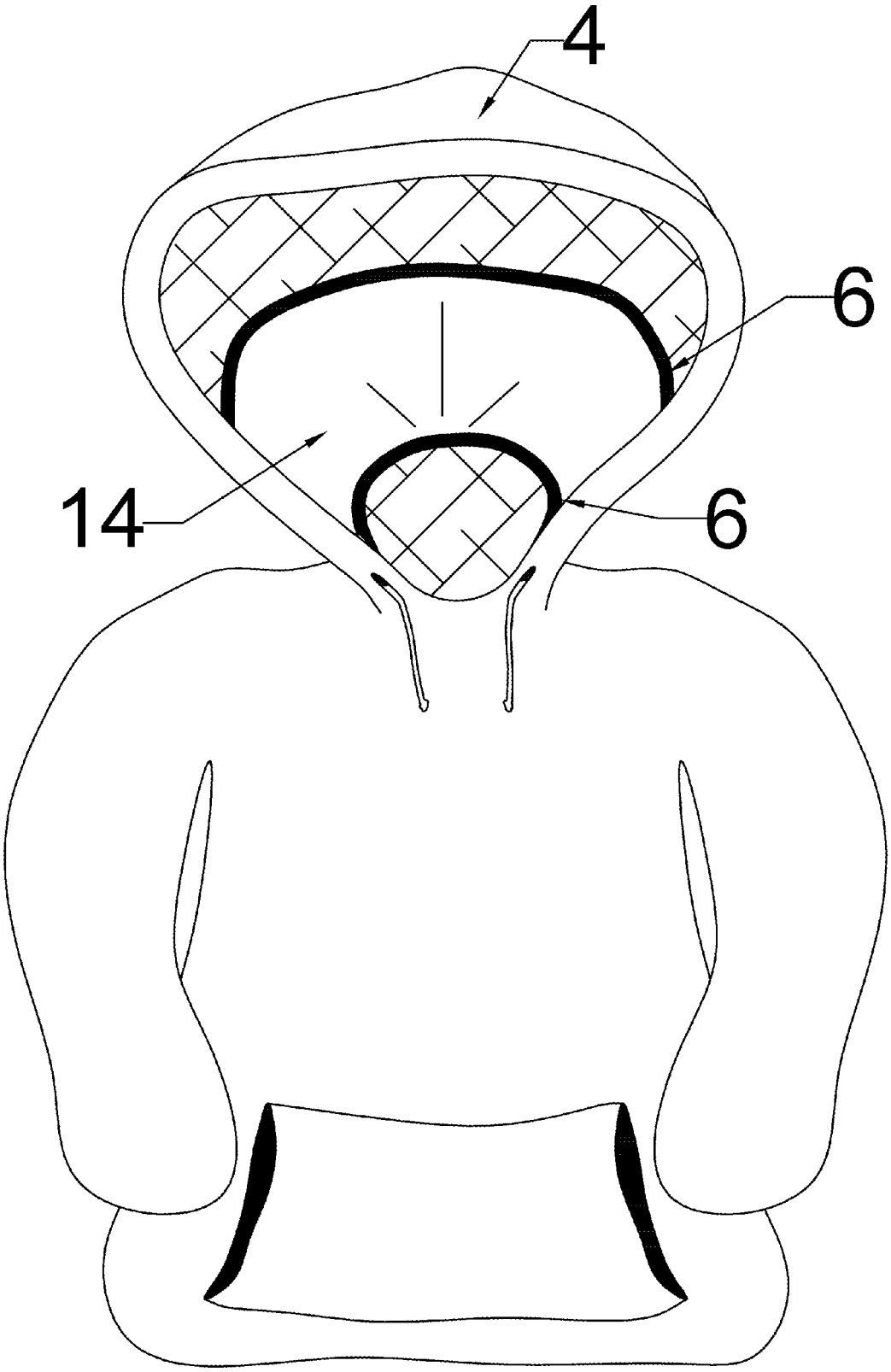
FIG. 15 shows a front view of a hoodie with a hidden fold down face mask folded back.
Figure 16:
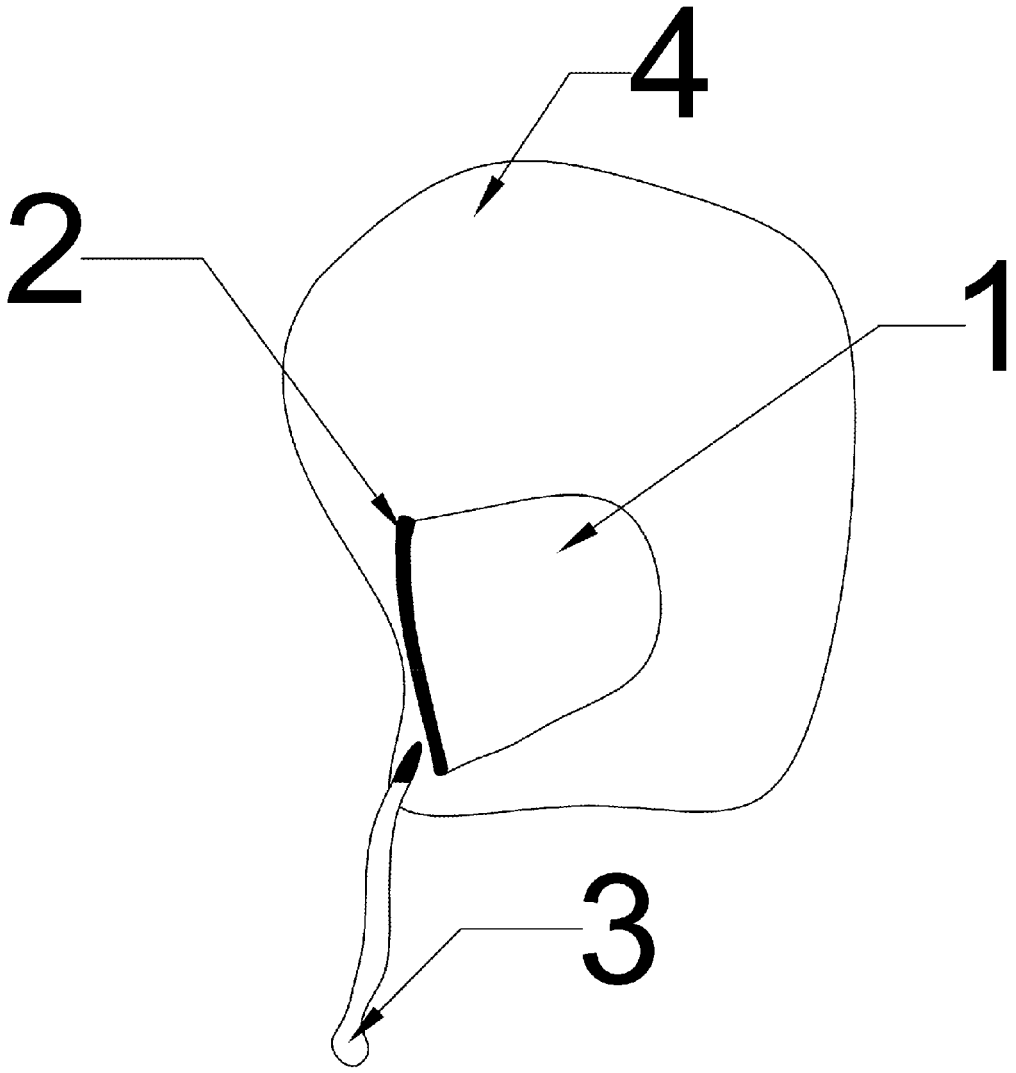
FIG. 16 shows an inside cross section view of a hoodie with an inside pocket.

A hoodie with a hidden fold down face mask placed behind the wearers head when in folded up position is shown in FIGS. 14 and 15. The face mask 14 is attached at both ends of the mask 14 to the inside lining of the hood 4 just inside the front opening of the hood 4. The face mask 14 has a top and bottom elastic band 6 for a more snug and tightened fit. The face mask 14 is approximately 6-11 inches wide (top to bottom) and 11-14 inches in length (fixed point to fixed point). The face mask 14 has its inside facing surface (surface in contact with the wearer's face) lined with fleece and the outside facing surface of the mask consisting of the same material of the outer hood or some other variation of materials. The face mask 14 is formed such that it can be stretched over the wearer's head when desired, and to be returned to a position behind the wearer's head when not desired for use. The hidden fold down face mask may have an elastic draw string with spring loaded locks (not shown in FIGS. 14 and 15) instead of the elastic band 6.

Self Adhering Face Mask

Figure 26:
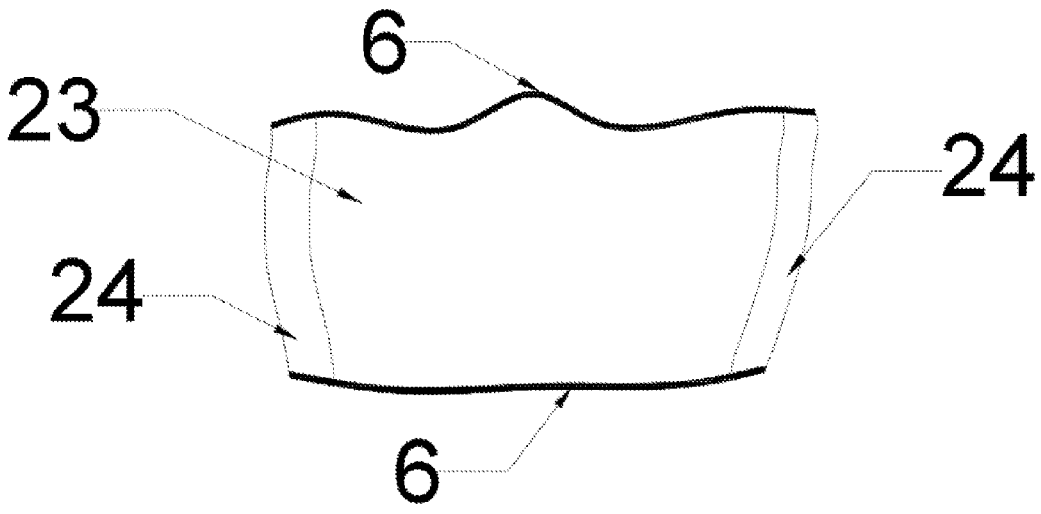
FIG. 26 shows a front view of a self adhering face mask.

A hoodie face mask 5 that self-adheres to both sides of a hood 4, e.g., as shown in FIG. 4, by the means of fastening fabric is shown in FIG. 26. The face mask 23 has adhesive fabric 24 at either end of the face mask 23 the full width of the face mask, permitting attachment to the hood 4. The face mask 23 has a top and bottom elastic band 6 for a more snug and tightened fit. The face mask 23 is approximately 6-11 inches wide (top to bottom) and 11-14 inches in length (fastener 24 to fastener 24). The face mask 23 has its inside facing surface (surface in contact with the wearer's face) lined with fleece and the outside facing surface of the mask consisting of the same material of the outer hood or some other variation of materials. In some embodiments, the hoodie face mask is disposable, similar in configuration to a medical face mask, with adhesive material allowing it to stick to the fabric of the hood 4, and thereafter be removed. In other cases, the face mark 4 is reusable, and the adhesive tabs are disposable. Alternately, the fastening elements for the face mask have barbs that retain the face mask to the hood 4, which can be reused after release. In yet another embodiment, a reusable adhesive material, such as a silicone gel, is provided to attach one or both sides of the face mask to the hood 4.

Figure 27:
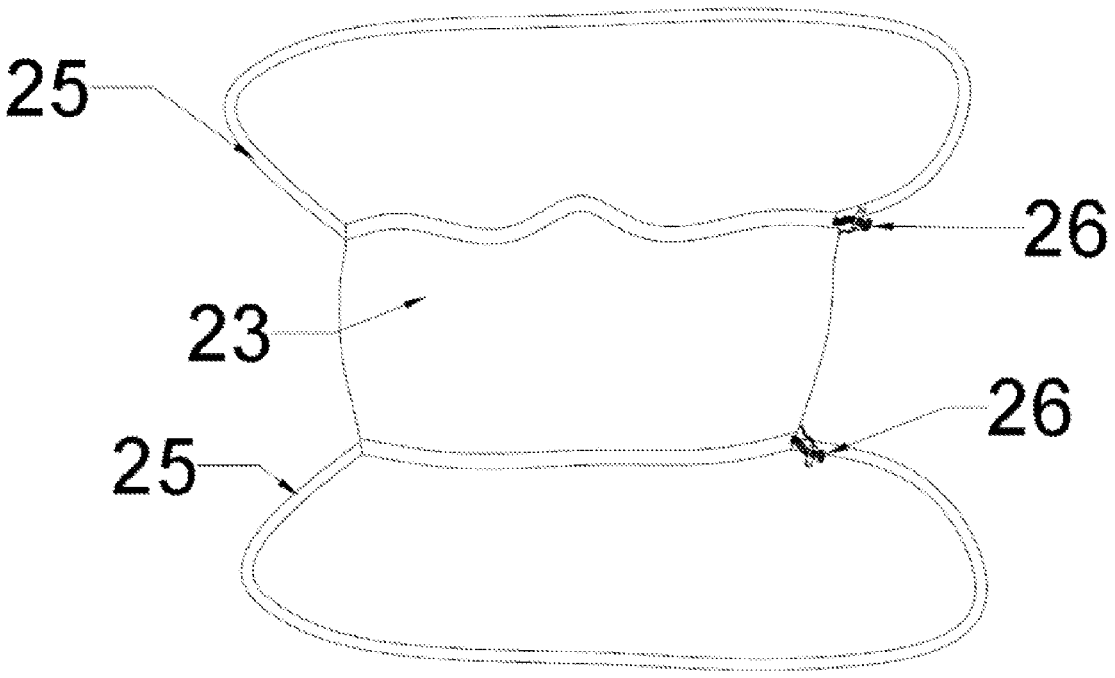
FIG. 27 shows a front view of a strapped face mask with elastic tightening draw strings.

The face mask 23 may be provided with elastic straps 25 which encircle the wearer's head, either inside or outside of the hood 4, which are tightened by an elastic draw string with spring loaded locks 26, as shown in FIG. 27.

Features of the present invention which are described in the context of separate embodiments may also be provided in combination or subcombination in a single embodiment. Conversely, features of the invention, including method steps, which are described for brevity in the context of a single embodiment or in a certain order may be provided separately or in any suitable subcombination or in a different order, "e.g." is used herein in the sense of a specific example which is not intended to be limiting.

What is claimed is:

1. A hooded garment, comprising:

a hood extending upward from a neck region, having an inner lining material and an outer hood material, forming adjacent layers, and having a front opening;

a space formed between the adjacent layers of the hood, defining a pocket, attached to the inner lining of the hood and having an opening proximate to a first lateral edge of the front opening of the hood, the pocket extending rearward from the first lateral edge of the front opening of the hood, between the adjacent layers;

a facemask, attached to the hood at a fixed end adjacent to an edge of the pocket at the first lateral edge of the front opening of the hood, and having an unfixed edge, extending a sufficient distance such that the facemask is configured to extend across a mouth and nose of a human wearer to an anchor proximate to a second lateral edge of the front opening of the hood, on a side of the hood opposite the pocket;

at least one anchor attachment element disposed on the unfixed edge of the facemask; and the at least one anchor attachment element being attachable to and detachable from the at least one anchor, being configured in an attached state to retain the facemask in position across the mouth and nose of the wearer during exercise and having elastically tensionable top and bottom edges, the facemask being configured to fit within the pocket in the detached state of the at least one anchor attachment element and the at least one anchor.

2. The hooded garment according to claim 1, wherein the facemask is configured to fit within the pocket substantially without bunching.

3. The hooded garment according to claim 1, wherein the facemask has at least one of a mouth hole and a nose hole.

4. The hooded garment according to claim 1, wherein the pocket has an opening 6-11 inches wide and 11-14 inches long.

5. The hooded garment according to claim 4, wherein the facemask is 6-11 inches wide and 11-14 inches long.

6. The hooded garment according to claim 1, wherein the facemask has a first surface and a second surface, the texture of the first surface being different texture from a texture of the second surface, the facemask being adapted to be placed across the nose and mouth of the wearer with either the first surface or second surface in contact with the wearer's skin.

7. The hooded garment according to claim 1, wherein the space is defined between two sheets of material forming the hood, wherein the edge of the pocket is defined at a seam between the two sheets of material.

8. The hooded garment according to claim 1, wherein the pocket is formed with an aperture through one of a pair of sheets of material, wherein the edge of the pocket is displaced from an edge of the hood.

9. The hooded garment according to claim 1, further comprising a chin flap formed at a lower portion of the hood, the chin flap extending from a neck upward.

10. The hooded garment according to claim 1, wherein the at least one anchor element comprises at least one of a hook and loop fastener, a button hole fastener, a snap button fastener, a zipper fastener, an adhesive fastener, a barbed fastener and a magnetic fastener.

11. The hooded garment according to claim 1, wherein at least one edge of the facemask is tensionable with a tightenable drawstring.

12. The hooded garment according to claim 11, wherein the at least one edge of the facemask which is tensionable with a tightenable drawstring comprises elastically reinforced top and bottom edges.

13. A hooded garment, comprising:

a shirt having a hood extending upward from a neck region, the hood having an inner lining material and an outer hood material, forming adjacent layers, and having a front opening;

a pocket formed near a first lateral edge of the hood, attached to the inner lining of the hood and having an opening proximate to a first lateral edge of the front opening of the hood, the pocket extending rearward from the first lateral edge of the front opening of the hood, between the adjacent layers, and having an opening bounded by an edge, the pocket having a space sufficient to contain a facemask, the facemask being fixed to the edge of the opening;

the facemask having elastically reinforced upper and lower edges, a free edge, and a fastener portion, the facemask being configured to protect a wearer's face from wind, and to absorb perspiration with a wicking material, while permitting breathing through the facemask when drawn across a wearers face; and a corresponding fastener portion formed near a second lateral edge of the hood, across the wearer's face from the first lateral edge, such that when the fastener portion is linked to the corresponding fastener, the facemask is drawn across the wearer's face outside of the pocket, and when the fastener portion is unlinked from the corresponding fastener, the facemask is removable from the wearer's face and insertable fully into the pocket.

14. The hooded garment according to claim 13, wherein the facemask has a mouth hole and at least one nose hole.

15. The hooded garment according to claim 13, wherein the pocket has an opening 6-11 inches wide and 11-14 inches long.

16. The hooded garment according to claim 13, wherein the elastically reinforced upper and lower edges are selectively tensionable.

17. The hooded garment according to claim 16, wherein the elastically reinforced upper and lower edges each have a drawstring whose tension is controlled by a spring loaded lock.

18. A hooded garment having an affixed facemask, comprising:

the facemask comprising:

a nasal region;

a mouth region;

the nasal region and the mouth region each being configured to permit passage of air for breathing therethrough;

tensionable elastically reinforced top and bottom edges; and fastener portions at a lateral edge thereof, the fastener portions being configured to, in a first configuration, attach to an edge of a hood of the hooded garment, to thereby be retained by corresponding fastener portions of the hood, in front of a face of a wearer, and in a second configuration, to be free to displace from the face of the wearer, the hood having an inner lining material and an outer hood material, forming adjacent layers, and having a front opening, and a pocket between the adjacent layers and being attached to the inner lining material, having an opening proximate to a lateral edge of hood, the facemask being fixed to the hood at the edge of the opening, the pocket extending rearward from the lateral edge of the hood, between the adjacent layers, and being adapted to hold the facemask.

19. The hooded garment according to claim 18, wherein the hooded garment comprises:

a pair of sleeves;

a covering for a torso; and a chin flap, having a first position wherein the chin of the wearer is exposed and the chin flap is situated in a neck region of the hooded garment, and a second position in which the chin of the wearer is covered and protected by the chin flap.

20. The hooded garment according to claim 19, wherein the facemask is formed having an inner and an outer layer, wherein the inner layer and the outer layer differ with respect to at least a perspiration absorption property, and wherein the hood has an edge having a tensionable drawstring.

* * * * *